US009984635B2

(12) United States Patent
Lee

(10) Patent No.: US 9,984,635 B2
(45) Date of Patent: May 29, 2018

(54) DISPLAY DEVICE HAVING A FIRST PIXEL COLUMN WITH DIFFERENT NUMBER OF PIXELS THAN A SECOND PIXEL COLUMN

(71) Applicant: Samsung Display Co., Ltd., Yongin, Gyeonggi-Do (KR)

(72) Inventor: Dong Eup Lee, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 180 days.

(21) Appl. No.: 14/574,260

(22) Filed: Dec. 17, 2014

(65) Prior Publication Data

US 2015/0228702 A1 Aug. 13, 2015

(30) Foreign Application Priority Data

Feb. 11, 2014 (KR) ..... 10-2014-0015651

(51) Int. Cl.
*G09G 3/36* (2006.01)
*G09G 3/20* (2006.01)

(52) U.S. Cl.
CPC ..... *G09G 3/3611* (2013.01); *G09G 3/2085* (2013.01); *G09G 2300/0404* (2013.01); *G09G 2310/0281* (2013.01); *G09G 2310/0283* (2013.01)

(58) Field of Classification Search
CPC ..... H01L 27/3262; H01L 27/3265; H01L 27/3276; G09G 3/3611; G09G 3/3644; G09G 3/3659; G09G 3/3666
See application file for complete search history.

(56) References Cited

U.S. PATENT DOCUMENTS 5,270,693 A * 12/1993 Wyler ..... G04G 9/0035 345/206
8,159,644 B2 * 4/2012 Takatori ..... G02F 1/134336 349/146
9,626,900 B2 * 4/2017 Anzai ..... G09G 3/3225
(Continued)

FOREIGN PATENT DOCUMENTS

JP 2008-216894 A 9/2008
KR 10-1075087 B1 10/2011
(Continued)

OTHER PUBLICATIONS

Korean Patent Abstracts of Application No. 10-2004-0077919, filed on Sep. 30, 2004, 1 page.

*Primary Examiner* — Anh Mai
(74) *Attorney, Agent, or Firm* — Lewis Roca Rothgerber Christie LLP

(57) ABSTRACT

Provided is a display device including a display panel having a display area including a plurality of pixel columns, the display device including: a first pixel column including i pixels (i is a natural number) from among the plurality of pixel columns; a second pixel column including j pixels (j is a different natural number than i) from among the plurality of pixel columns; a first data line connected to the i pixels in the first pixel column, and to k pixels (k is a smaller natural number than j) from among the j pixels in the second pixel column; a second data line connected to j minus k (j-k) pixels from among the j pixels in the second pixel column; and gate lines connected to pixels in the first pixel column and the second pixel column.

20 Claims, 20 Drawing Sheets

(56) References Cited

U.S. PATENT DOCUMENTS

| | | | | |
|---|---|---|---|---|
| 2005/0225690 | A1* | 10/2005 | Battersby | G02F 1/13336 349/41 |
| 2006/0077191 | A1* | 4/2006 | Ming-Daw | G02F 1/133351 345/204 |
| 2008/0018557 | A1* | 1/2008 | Maeda | G02F 1/167 345/55 |
| 2008/0018583 | A1* | 1/2008 | Knapp | G02F 1/1333 345/99 |
| 2009/0189835 | A1* | 7/2009 | Kim | G09G 3/3677 345/80 |
| 2010/0289994 | A1* | 11/2010 | Nonaka | G02F 1/133514 349/108 |
| 2012/0112988 | A1* | 5/2012 | Nakanishi | G02F 1/134309 345/76 |
| 2014/0043306 | A1* | 2/2014 | Min | G09G 3/3685 345/204 |
| 2014/0253419 | A1* | 9/2014 | Tanada | G09G 3/2092 345/55 |
| 2016/0171938 | A1* | 6/2016 | Na | G09G 3/3688 345/698 |

FOREIGN PATENT DOCUMENTS

| | | | |
|---|---|---|---|
| KR | 10-2011-0130177 | A | 12/2011 |
| KR | 10-2012-0011294 | A | 2/2012 |

* cited by examiner

DISPLAY DEVICE HAVING A FIRST PIXEL COLUMN WITH DIFFERENT NUMBER OF PIXELS THAN A SECOND PIXEL COLUMN

CROSS-REFERENCE TO RELATED APPLICATION

This application claims priority to and the benefit of Korean Patent Application No. 10-2014-0015651, filed on Feb. 11, 2014, the entire content of which is hereby incorporated by reference.

BACKGROUND

Aspects of embodiments of the present disclosure herein are directed towards a display device, and more particularly, to a display device having an atypical pixel array.

Various display devices providing multimedia, for example, televisions, mobile phones, navigation systems, computer monitors, and game consoles, have been developed. The display devices have a rectangular form generally on the front where an image is provided. The rectangular form of a display device has a pixel array in a matrix.

According to recent user's demands, the forms (e.g., the shapes) of the display devices are being transformed. The forms of the display devices are transformed from a typical rectangular form into various forms, such as a triangular form and a pentagonal form. As the form is transformed, the display device has an atypical pixel array.

SUMMARY

Aspects of embodiments of the present disclosure are directed towards a display device having an atypical pixel array with improved driving efficiency.

An embodiment of the present invention provides a display device including a display panel having a display area including a plurality of pixel columns, the display device including: a first pixel column including i pixels (i is a natural number) from among the plurality of pixel columns; a second pixel column including j pixels (j is a different natural number than i) from among the plurality of pixel columns; a first data line connected to the i pixels in the first pixel column, and to k pixels (k is a smaller natural number than j) from among the j pixels in the second pixel column; a second data line connected to j minus k (j-k) pixels from among the j pixels in the second pixel column; and gate lines connected to pixels in the first pixel column and the second pixel column.

The k pixels may be continuously disposed along an extended direction of the second pixel column, and the j-k pixels may be continuously disposed from the k pixels.

The pixels connected to the first data line may be defined as a first pixel group, the pixels connected to the second data line may be defined as a second pixel group, and the first pixel group and the second pixel group may include same number of pixels The plurality of pixel columns may further include a third pixel column between the first pixel column and the second pixel column. The third pixel column may include a different number of pixels than that of the first pixel column and a different number of pixels than that of the second pixel column.

The third pixel column may include the same number of pixels as the first pixel group.

The first data line may include a first portion adjacent to the first pixel column, a second portion adjacent to the second pixel column, and a third portion connecting one end of the first portion to one end of the second portion.

The pixels of the second pixel group may be configured to be sequentially turned on, and each of the pixels of the first pixel group may be configured to be turned on in synchronization with a corresponding pixel from among the pixels of the second pixel group.

The gate lines may include: first gate lines configured to receive gate signals for turning on the pixels in the first pixel column of the first pixel group and the pixels of the second pixel group; and second gate lines configured to receive gate signals for turning on the k pixels in the second pixel column of the first pixel group.

One first gate line from among the first gate lines may be connected to a pixel in the first pixel column of the first pixel group and to a pixel of the second pixel group.

Another first gate line from among the first gate lines may not be connected to the pixels of the first pixel group, and may be connected to another pixel of the second pixel group.

Each of the pixels of the first pixel group may be connected to a same gate line as that of which a corresponding pixel among the pixels of the second pixel group is connected.

Each of the pixels of the first pixel group and the second pixel group may include: a thin film transistor connected to a corresponding data line from among the first data line and the second data line, and connected to a corresponding gate line from among the gate lines; and a liquid crystal capacitor connected to the thin film transistor.

Each of the pixels of the first pixel group and the second pixel group may include: a first thin film transistor connected to a corresponding data line from among the first data line and the second data line, and connected to a corresponding gate line from among the gate lines; a capacitor connected to the first thin film transistor; a second thin film transistor connected to the first thin film transistor and to the capacitor; and an organic light emitting diode connected to the second thin film transistor.

A group of continuously disposed pixel columns from among the plurality of pixel columns may be defined as a first pixel column group, and each of the pixel columns of the first pixel column group may include different numbers of pixels than other ones of the pixel columns of the first pixel column group.

A number of each of the pixel columns of the first pixel column group may gradually decrease as it is farther away from a pixel column having a largest number of pixels from among the first pixel column group.

Another group of continuously disposed pixel columns from among the plurality of pixel columns may be defined as a second pixel column group, and each of the pixel columns of the second pixel column group includes different numbers of pixels than other ones of the pixel columns of the second pixel column group, wherein a number of pixels of each of the pixel columns of the second pixel column group may gradually decrease as it is farther away from a pixel column having a largest number of pixels from among the second pixel column group.

The pixel column of the first pixel column group having the largest number of pixels, and the pixel column of the second pixel column group having the largest number of pixels may be at a center of the plurality of pixel columns; and the display area may have a triangular form on a front of the display panel.

The display panel may further include a non-display area adjacent to the display area, and a border of the non-display area may have a triangular form.

The display panel may have a triangular form on the front.

BRIEF DESCRIPTION OF THE DRAWINGS

The accompanying drawings are included to provide a further understanding of the inventive concept, and are incorporated in and constitute a part of this specification. The drawings illustrate example embodiments of the inventive concept, and together with the description, serve to describe aspects of the inventive concept. In the drawings.

DETAILED DESCRIPTION

Hereinafter, example embodiments will be described in more detail with reference to the accompanying drawings.

Expressions such as "at least one of," when preceding a list of elements, modify the entire list of elements and do not modify the individual elements of the list. Further, the use of "may" when describing embodiments of the present invention refers to "one or more embodiments of the present invention."

When an element is described as "coupled" or "connected" to another element, the element may be "directly coupled" or "directly connected" to the other element, or "indirectly coupled" or "indirectly connected" to the other element through one or more intervening elements.

Figure 1:
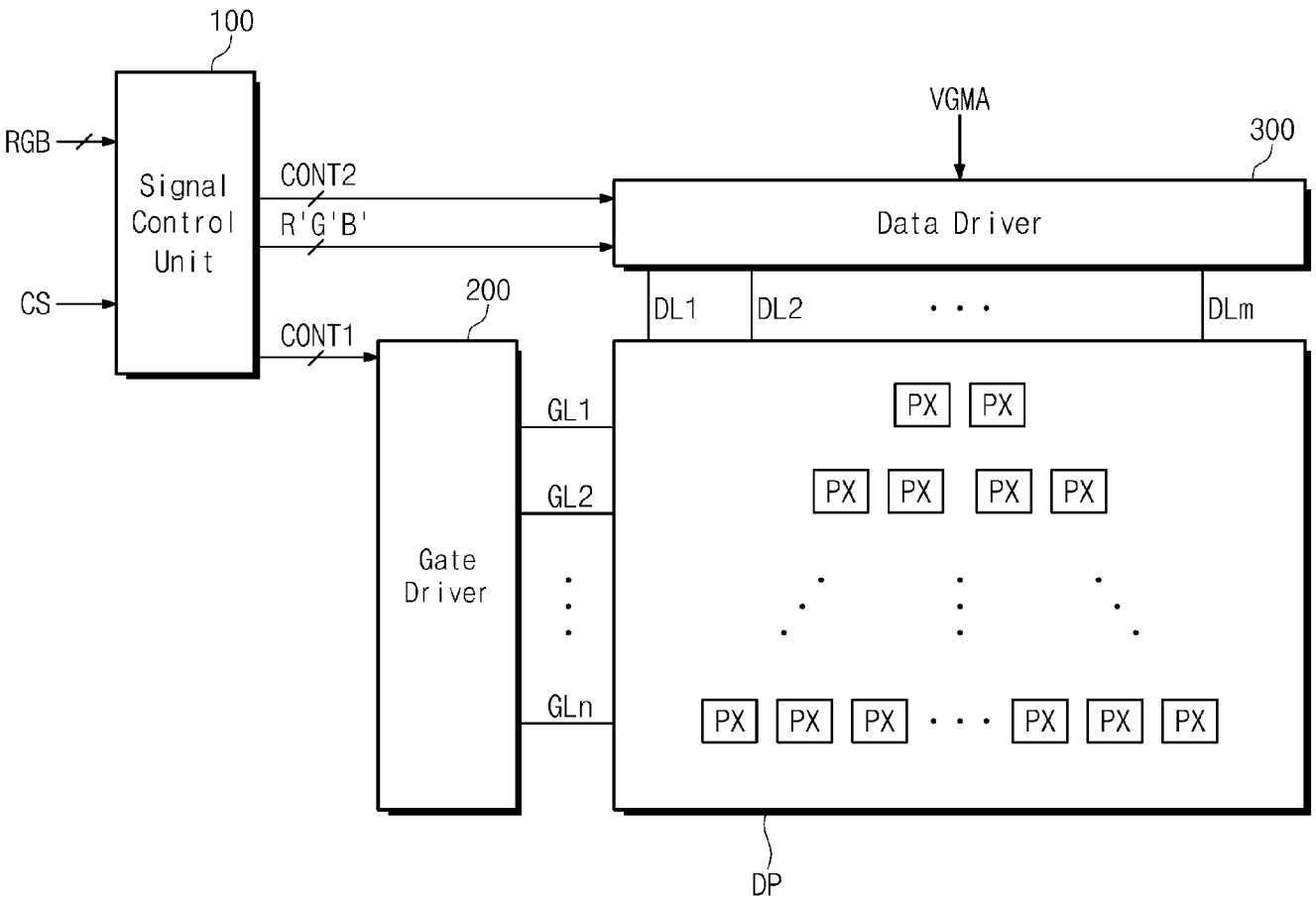
FIG. 1 is a block diagram illustrating a display device according to an embodiment of the inventive concept.

FIG. 1 is a block diagram illustrating a display device according to an embodiment of the inventive concept. As shown in FIG. 1, the display device includes a display panel DP, a signal control unit 100 (e.g., a signal controller), a gate driver 200, and a data driver 300. The signal control unit 100, the gate driver 200, and the data driver 300 control the display panel DP, thereby generating an image.

The display panel DP includes a plurality of gate lines GL1 to GLn, a plurality of data lines DL1 to DLm, and a plurality of pixels PX. The display panel DP is not limited to a specific one of display panels, and for example, may include a liquid crystal display panel, an organic light emitting display panel, an electrophoretic display panel, or an electrowetting display panel.

The plurality of pixels PX are arranged atypically. According to an array of the plurality of pixels PX, the form of a display area of the display panel DP is determined. The display area is an area where the image is generated. The array of the plurality of pixels PX, the array of the plurality of gate lines GL1 to GLn, and the plurality of data lines DL1 to DLm will be described later.

The signal control unit 100 receives input image signals RGB, and converts the input image signals RGB into image data R'G'B' fit for an operation of the display panel DP. Additionally, the signal control unit 100 receives various control signals CS, for example, a vertical sync signal, a horizontal sync signal, and a plurality of clock signals, and outputs a first control signal CONT1 and a second control signal CONT1.

The gate driver 200 outputs gate signals to the plurality of gate lines GL1 to GLn in response to the first control signal CONT1. The first control signal CONT1 includes a vertical start signal for starting an operation of the gate driver 200 and a gate clock signal for determining an output timing of a gate voltage.

The data driver 300 receives the second control signal CONT2, the image data R'G'B', and gamma voltage VGMA. The data driver 300 converts the image data R'G'B' into data signals, and then provides the data signals to the data lines DL1 to DLm. The second control signal CONT2 includes a horizontal start signal for starting an operation of the data driver 300, a polarity control signal for controlling the polarity of the data signals, and a load signal for determining the timing at which the data signals are outputted.

Figure 2A:
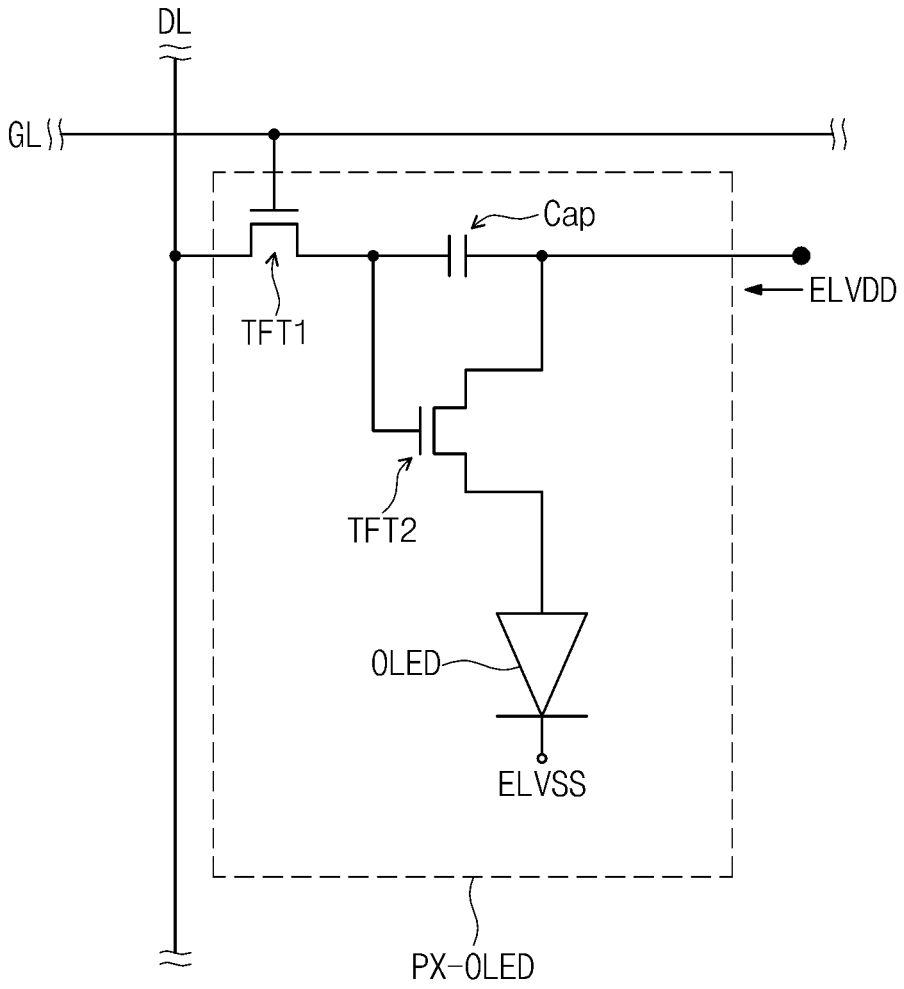
FIGS. 2A and 2B are views illustrating equivalent circuit diagrams of a pixel according to embodiments of the inventive concept.
Figure 2B:
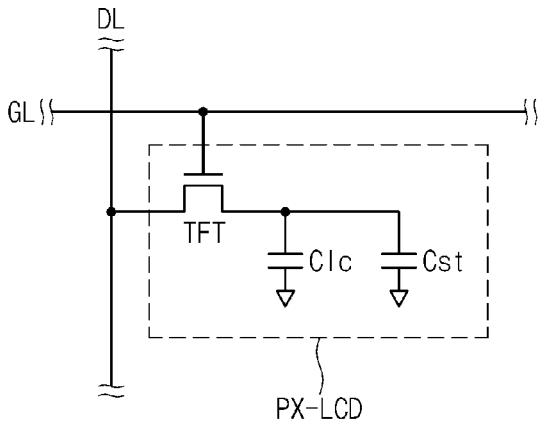

FIGS. 2A and 2B are views illustrating equivalent circuit diagrams of a pixel according to embodiments of the inventive concept. FIG. 2A illustrates a pixel of an organic light emitting display panel and FIG. 2B illustrates a pixel of a liquid crystal display panel.

As shown in FIG. 2A, an organic light emitting pixel PX-OLED is connected to a corresponding gate line GL among the plurality of gate lines GL1 to GLn, and to a corresponding data line DL among the plurality of data lines DL1 to DLm. The organic light emitting pixel PX-OLED is turned on by a gate signal applied from the corresponding gate line GL. The organic light emitting pixel PX-OLED receives different levels of a first voltage ELVDD and a second voltage ELVSS, and generates light (e.g., predetermined light).

The organic light emitting pixel PX-OLED includes a first thin film transistor TFT1, a capacitor Cap, a second thin film transistor TFT2, and an organic light emitting diode OLED. The first thin film transistor TFT1 is connected to the corresponding gate line GL and the corresponding data line DL. The first thin film transistor TFT1 outputs a data signal applied to the corresponding data line DL in response to the gate signal applied to the corresponding gate line GL.

The capacitor Cap charges a voltage corresponding to the data signal. The capacitor Cap controls a turn-on time or an activation degree of the second thin film transistor TFT2.

The second thin film transistor TFT2 controls a driving current flowing in the organic light emitting diode OLED. The organic light emitting diode OLED emits light while the second thin film transistor TFT2 is turned on. The first electrode (e.g., an anode) of the organic light emitting diode OLED receives a voltage corresponding to the first voltage ELVDD from the second thin film transistor TFT2, and the second electrode (e.g., a cathode) of the light emitting diode OLED receives the second voltage ELVSS. However, the present invention is not limited thereto, and a configuration of the organic light emitting pixel PX-OLED may vary.

As shown in FIG. 2B, a liquid crystal pixel PX-LCD is turned on by a gate signal applied from the corresponding gate line GL. The liquid crystal pixel PX-LCD may transmit/block light provided from a backlight unit.

The liquid crystal pixel PX-LCD includes a thin film transistor TFT connected to a corresponding gate line GL and a corresponding data line DL, and a liquid crystal capacitor Clc connected to the thin film transistor TFT. The liquid crystal pixel PX-LCD includes a storage capacitor Cst connected in parallel to the liquid crystal capacitor Clc. However, the storage capacitor Cst may be omitted.

The thin film transistor TFT outputs a data signal applied to the corresponding data line DL in response to the gate signal applied to the corresponding gate line GL. The liquid crystal capacitor Clc charges a voltage corresponding to the data signal. In correspondence to a charged voltage of the liquid crystal capacitor Clc, light provided from the backlight unit is transmitted/blocked. However, the present invention is not limited thereto, and a configuration of the liquid crystal pixel PX-LCD may vary.

Figure 3A:
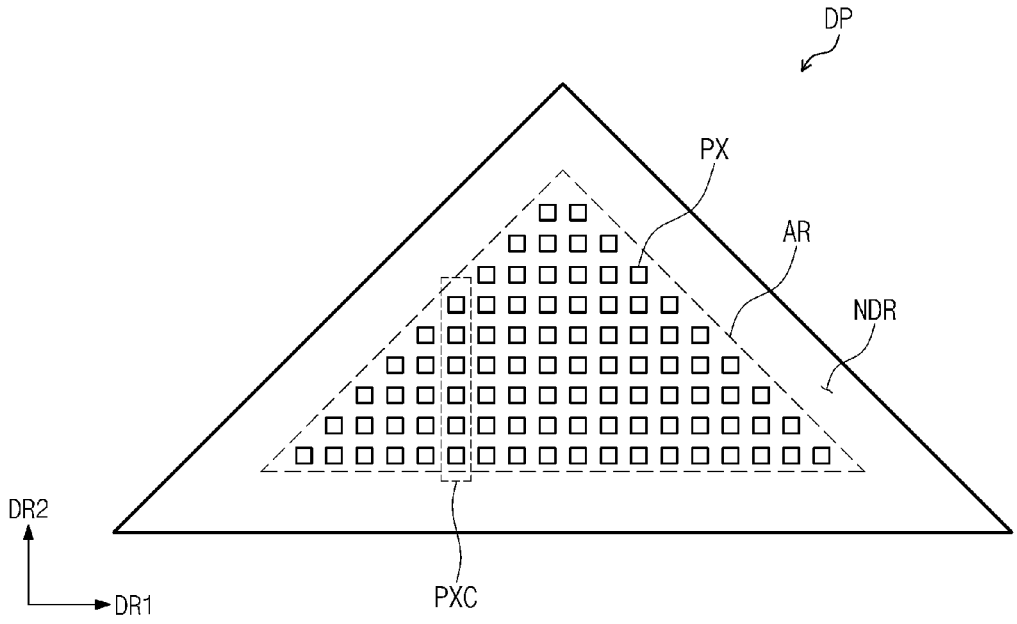
FIGS. 3A and 3B are plan views illustrating a display panel according to embodiments of the inventive concept.
Figure 3B:
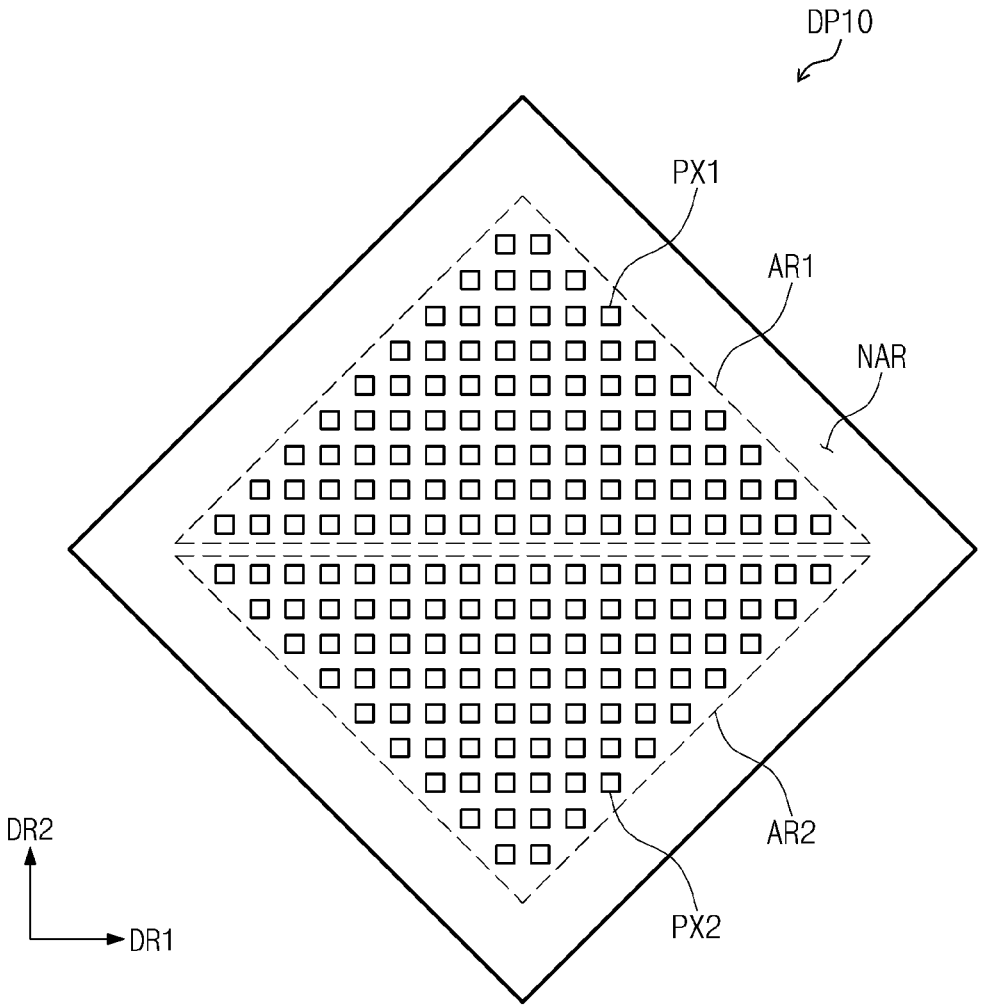

FIGS. 3A and 3B are plan views illustrating a display panel according to embodiments of the inventive concept. FIGS. 3A and 3B illustrate different forms (e.g., shapes) of display panels DP and DP10. Each of the display panels DP and DP10 includes at least one base substrate. In embodiments of the inventive concept, the form of the base substrate determines the forms of the display panels DP and DP10.

The plurality of gate lines GL1 to GLn shown in FIG. 1, the plurality of data lines DL1 to DLm shown in FIG. 1, and the plurality of pixels PX are arranged on the base substrate. The display panel DP includes a plurality of insulating layers, a plurality of conductive layers, and a functional layer, for example, a liquid crystal layer and a light emitting layer, on the base substrate. The plurality of insulating layers insulate the plurality of conductive layers from each other. The plurality of conductive layers configure electrodes or wires of a pixel PX.

As shown in FIG. 3A, the display panel DP may have a triangular form on the front. The front is a side where an image is displayed. The front may be defined by a first direction DR1 and a second direction DR2 perpendicular to each other.

The plurality of pixels PX form a plurality of pixel columns and a plurality of pixel rows. The plurality of pixels PX may be spaced at a same interval apart from each other. Hereinafter, the plurality of pixel columns is described. The plurality of pixel columns PXC may be arranged along the first direction DR1. Pixels PX in each of the plurality of pixel columns PXC may be arranged along the second direction DR2.

Except for some pixel columns PXC, most of the plurality of pixel columns may include a different number of pixels PX. Among some pixel columns PXC, one pixel column may include i pixels (i is a natural number) and another pixel column may include j pixels (j is a natural number different from i). The reason for including a different number of pixels according to pixel columns in such a way is that the plurality of pixels PX are arranged in a different form than a typical matrix.

An area where the plurality of pixel columns PXC are arranged is defined as a display area AR. The display area AR may have a triangular form on the front. An area where the plurality of pixel columns PXC are not arranged is defined as a non-display area NDR (or NAR in FIG. 3B). A pad part of a signal wire or driving drivers may be disposed in the non-display area NDR (or NAR in FIG. 3B).

As shown in FIG. 3B, the display panel DP10 may have a rhombic form on the front. The display panel DP10 includes a first display area AR1 and a second display area AR2. The first display area AR1 has the same pixel array as the display area shown in FIG. 3A. The second display area AR2 has a pixel array vertically symmetric to that of the first display area AR1.

Pixels PX1 arranged in the first display area AR1 and pixels PX2 arranged in the second display area AR2 may be separately controlled. A display device according to an embodiment of the inventive concept may include a driving driver for controlling the pixels PX1 arranged in the first display area AR1 and a driving driver for controlling the pixels PX2 arranged in the second display area AR2.

The form of the display panel DP10 is not limited to that shown in FIG. 3B. For example, according to another embodiment of the inventive concept, the display panel DP10 may have a pentagonal form on the front. In this case, pixels PX2 included in a second display area AR2 may be arranged in a typical matrix.

Figure 4:
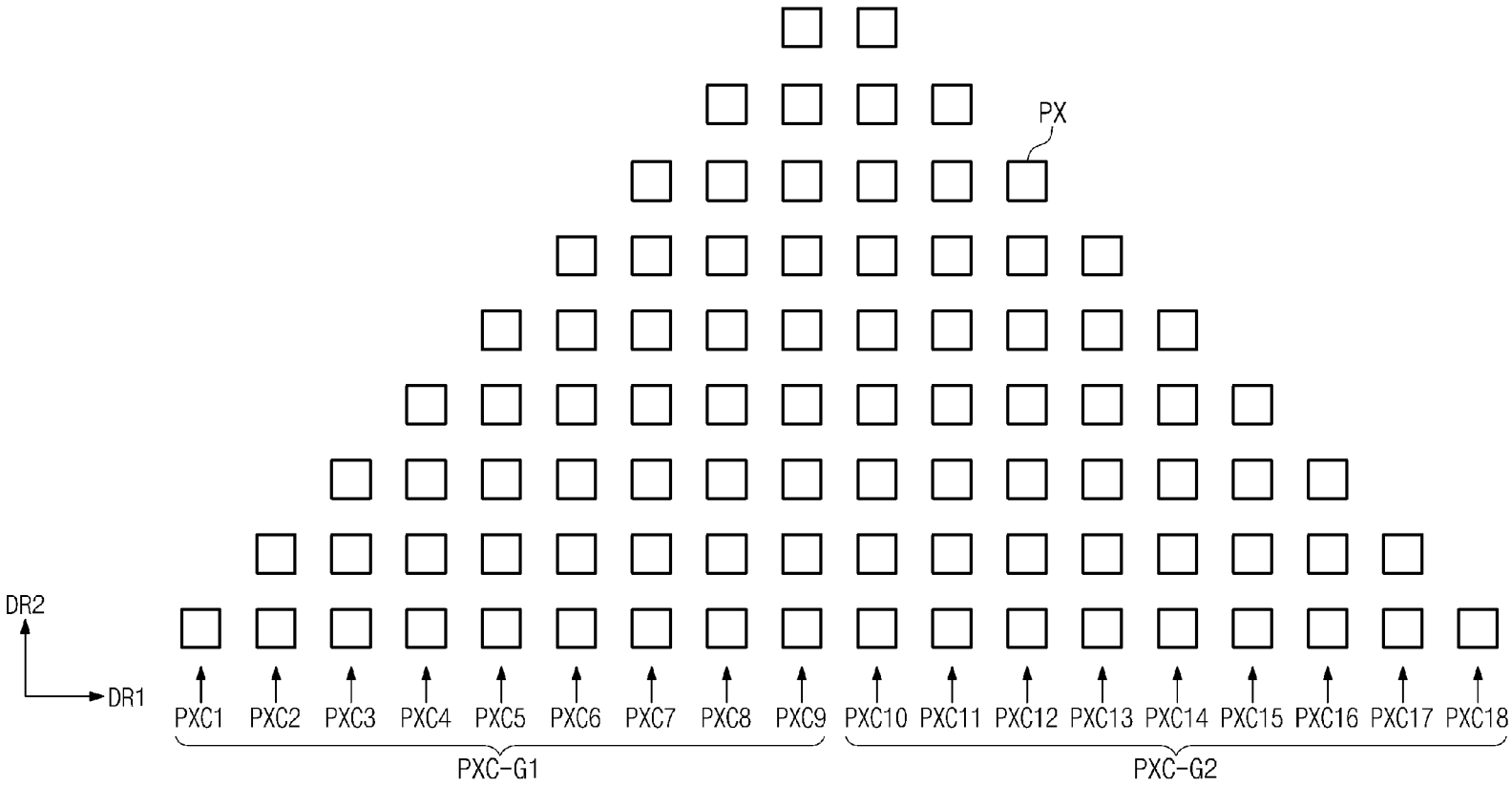
FIG. 4 is a block diagram illustrating a pixel array of a display panel according to an embodiment of the inventive concept.

FIG. 4 is a block diagram illustrating a pixel array of a display panel according to an embodiment of the inventive concept. FIG. 4 is an enlarged view of the display area AR of FIG. 3A, and eighteen pixel columns PXC1 to PXC18 are shown. Hereinafter, referring to FIG. 4, a pixel array according to an embodiment of the inventive concept is described in more detail.

First to ninth pixel columns PXC1 to PXC9 among the pixel columns PXC1 to PXC18 are defined as a first pixel column group PXC-G1, and tenth to eighteenth pixel columns PXC10 to PXC18 are defined as a second pixel column group PXC-G2. The first pixel column group PXC-G1 and the second pixel column group PXC-G2 have a horizontally symmetric pixel array. Hereinafter, a pixel array is described based on the first pixel column group PXC-G1. According to an embodiment of the inventive concept, the second pixel column group PXC-G2 may be omitted.

The first to ninth pixel columns PXC1 to PXC9 include different numbers of pixels PX. The ninth pixel column PXC9 placed at or near the center among the eighteen pixel columns PXC1 to PXC18, includes the largest number of pixels PX in the first pixel column group PXC-G1. The ninth pixel column PXC9 includes nine pixels PX.

The first to eighth pixel columns PXC1 to PXC8 include pixels PX whose number is gradually reduced as it becomes farther away from the ninth pixel column PXC9. Each of the first to eighth pixel columns PXC1 to PXC8 respectively includes one to eight pixels PX.

In the second direction DR2, pixels PX disposed at the lowermost part of the second to ninth pixel columns PXC2 to PXC9 may be aligned along the first direction DR1 from the pixel PX of the first pixel column PXC1. Accordingly, pixels PX included in the eighteen pixel columns PXC1 to PXC18 may define the triangular display area AR of FIG. 3A on the front.

Figure 5:
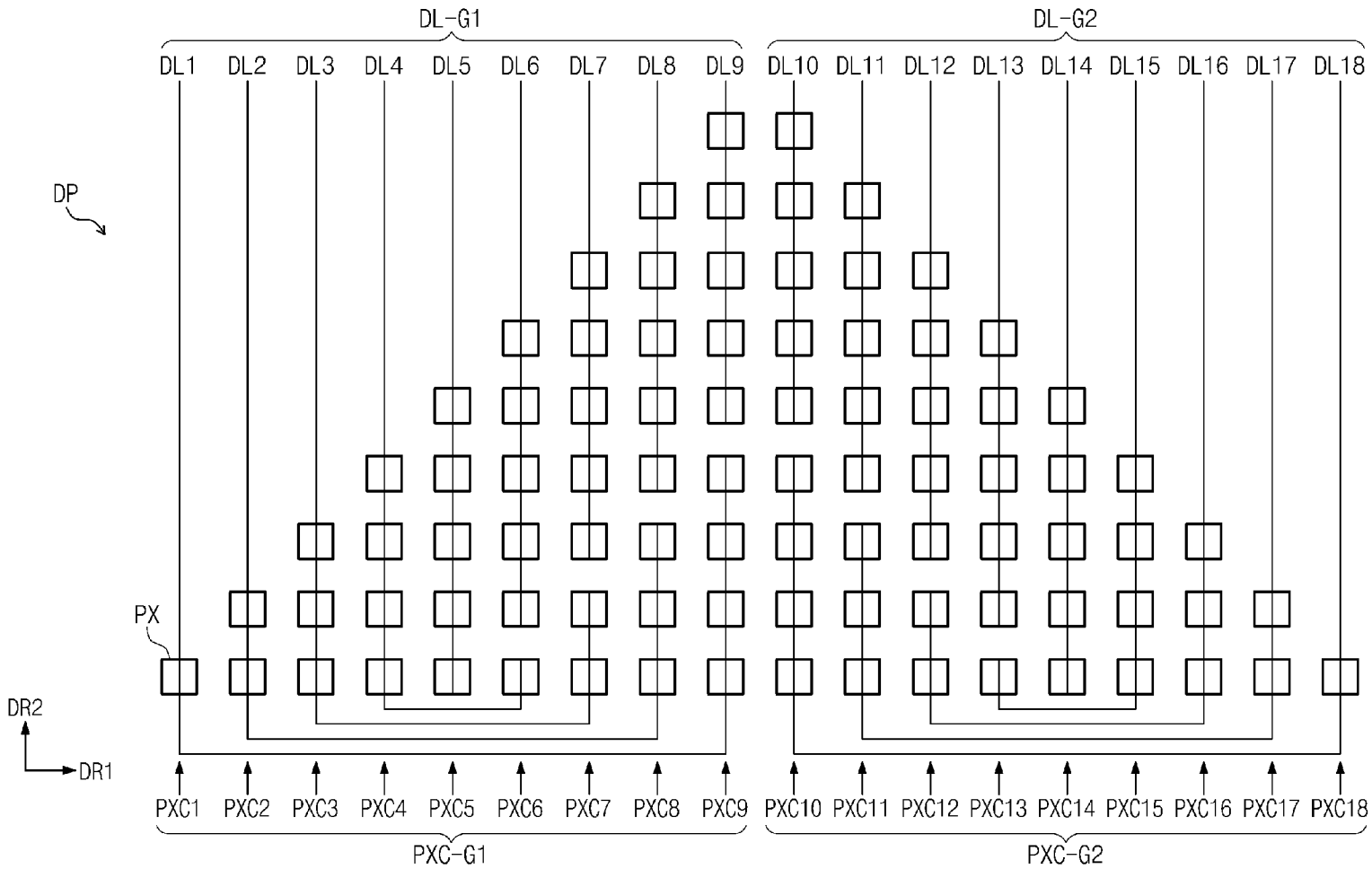
FIG. 5 is a view illustrating data lines of a display panel according to an embodiment of the inventive concept.
Figure 6:
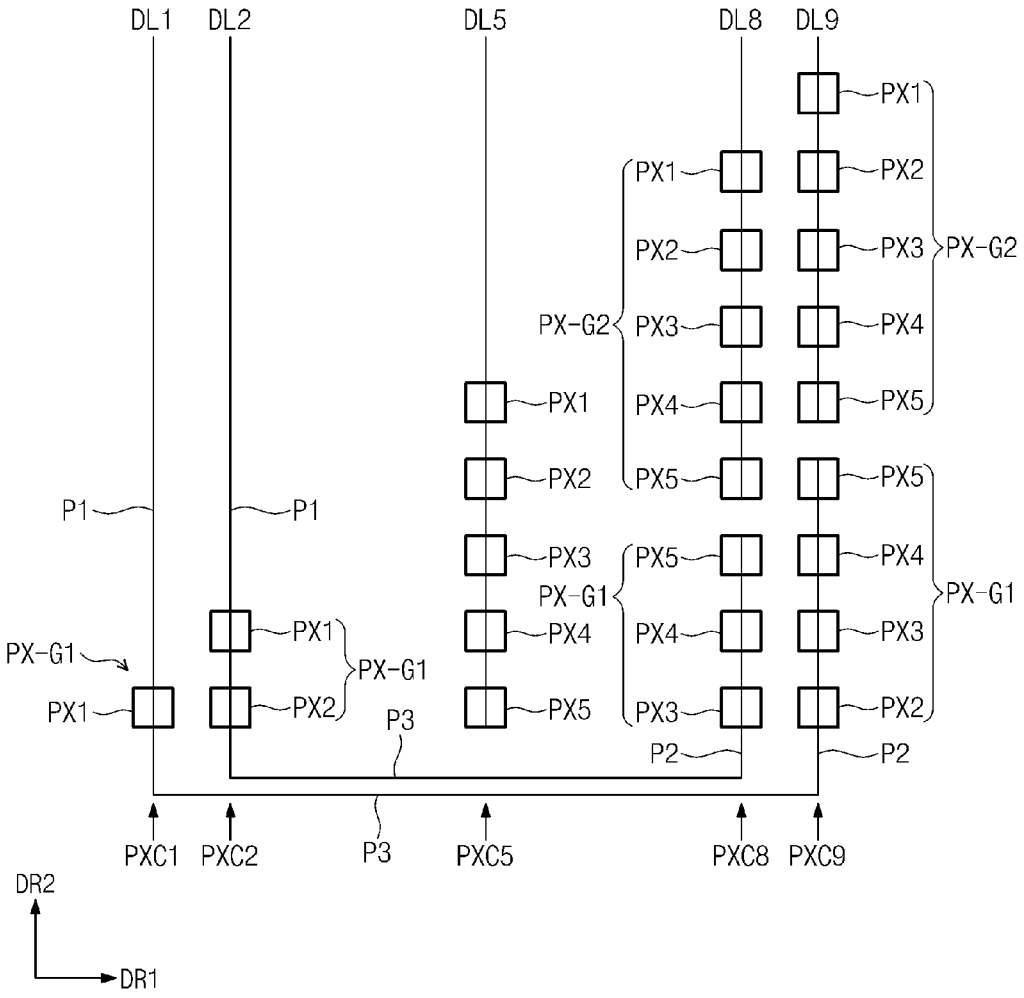
FIG. 6 is an enlarged view of a portion of FIG. 5.

FIG. 5 is a view illustrating data lines of a display panel according to an embodiment of the inventive concept. FIG. 6 is an enlarged view of a portion of FIG. 5. Eighteen data lines DL1 to DL18 are shown in FIG. 5 as an example. Hereinafter, referring to FIGS. 5 and 6, a connection relationship between the data lines DL1 to DL18 and the pixels according to an embodiment of the inventive concept is described in more detail.

As shown in FIG. 5, the first to ninth data lines DL1 to DL9 among the eighteenth data lines DL1 to DL18 are defined as a first data line group DL-G1, and the tenth to eighteenth data lines DL10 to DL18 are defined as a second data line group DL-G2. The first data line group DL-G1 is connected to the first pixel column group PXC-G1, and the second data line group DL-G2 is connected to the second pixel column group PXC-G2. The first data line group DL-G1 and the second data line group DL-G2 have a horizontally symmetric array. Hereinafter, a connection relationship between a data line and a pixel is described based on the first data line group DL-G1.

One data line among the first to ninth data lines DL1 to DL9 is connected to a different pixel column. The one data line is connected to pixels included in two pixel columns. The one data line may be connected to a pixel column including i pixels (i is 1 to 4 in this embodiment) and a pixel column including j pixels (j is 5 to 9 in this embodiment). The one data line is connected to the i pixels, and to k pixels (k is a natural number less than j) among the j pixels.

Another data line among the first to ninth data lines DL1 to DL9 is connected to a pixel column including the j pixels. The other data line may be connected to j minus k (j-k) pixels, e.g., some pixels in a pixel column including the j pixels.

Yet another data line among the first to ninth data lines DL1 to DL9 is connected to only one pixel column and is connected to all pixels included in the one pixel column.

As shown in FIG. 6, the first data line DL1 is connected to a pixel of the first pixel column PXC1 and some pixels among pixels of the ninth pixel column PXC9. The ninth data line DL9 is connected to pixels not connected to the first data line DL1 among the pixels of the ninth pixel column PXC9.

The pixel of the first pixel column PXC1 and the pixels connected to the first data line DL1 among the pixels of the ninth data line DL9 are defined as a first pixel group PX-G1. The pixels connected to the ninth data line DL9 among the pixels of the ninth pixel column PXC9 are defined as a second pixel group PX-G2.

The second pixel group PX-G2 may include pixels continuously arranged from the top in the second direction DR2 among the pixels of the ninth pixel column PXC9. The first pixel group PX-G1 and the second pixel group PX-G2 have the same number of pixels. As shown in FIG. 6, each of the first pixel group PX-G1 and the second pixel group PX-G2 has five pixels PX1 to PX5.

The second data line DL2 is connected to the pixels of the second pixel column PXC2 and some pixels among the pixels of the eighth pixel column PXC8. The eighth data line DL8 is connected to pixels not connected to the second data line DL2 among the pixels of the eighth pixel column PXC8. The pixels of the second pixel column PXC2 and the pixels of the eighth pixel column PXC8 connected to the second data line DL2 are defined as the first pixel group PX-G1. The pixels of the eighth pixel column PXC8 connected to the eighth data line DL8 are defined as the second pixel group PX-G2.

The fifth data line DL5 is connected to all the pixels of the fifth pixel column PXC5. The fifth pixel column PXC5 includes the same number of pixels PX1 to PX5 as the first pixel group PX-G1 or the second pixel group PX-G2. As a result, each of the eighteen data lines DL1 to DL18 shown in FIG. 5 is connected to the same number of pixels PX1 to PX5.

Each of the first data line DL1 and the second data line DL2 includes three portions P1, P2, and P3. Referring to the first data line DL1, the three portions P1, P2, and P3 include a first portion P1 adjacent to the first pixel column PXC1, a second portion P2 adjacent to the ninth pixel column PXC9, and a third portion P3 connecting one end of the first portion P1 and one end of the second portion P2. The third portion P3 may be disposed in the non-display area NDR of FIG. 3A.

The pixels PX1 to PX5 included in each of the first pixel group PX-G1 and the second pixel group PX-G2 may be turned on by different gate signals. That is, the pixels PX1 to PX5 are turned on at different times. According to the order at which the pixels PX1 to PX5 are turned on, the pixels PX1 to PX5 are defined as first to fifth pixels PX1 to PX5.

For example, referring to the ninth pixel column PXC9, the second pixel PX2 of the first pixel group PX-G1 and the second pixel PX2 of the second pixel group PX-G2 may be turned on concurrently (e.g., simultaneously). In this case, the second pixel PX2 of the first pixel group PX-G1 receives a data signal outputted from the first data line DL1 and the second pixel PX2 of the second pixel group PX-G2 receives a data signal outputted from the ninth data line DL9.

Referring to the ninth pixel column PXC9, the second pixels PX2 of the first pixel group PX-G1 and the second pixel group PX-G2 may be turned on concurrently (e.g., simultaneously); the third pixels PX3 of the first pixel group PX-G1 and the second pixel group PX-G2 may be turned on concurrently (e.g., simultaneously); the fourth pixels PX4 of the first pixel group PX-G1 and the second pixel group PX-G2 may be turned on concurrently (e.g., simultaneously); and the fifth pixels PX5 of the first pixel group PX-G1 and the second pixel group PX-G2 may be turned on concurrently (e.g., simultaneously). Accordingly, the number of scanning the gate signal for turning on all pixels included in the ninth pixel column PXC9 is reduced. As the number of scanning the gate signal is reduced, each time of the horizontal intervals with respect to a frame interval (e.g., a predetermined frame interval) is increased.

According to the order at which five pixels PX1 to PX5 included in the fifth pixel column PXC5 are turned on, the five pixels PX1 to PX5 are defined as first to fifth pixels PX1 to PX5. Each of the first to fifth pixels PX1 to PX5 of the fifth pixel column PXC5 is turned on in synchronization with a corresponding pixel among the first to fifth pixels PX1 to PX5 of the first pixel group PX-G1 or the second pixel group PX-G2. As a result, the pixels PX connected to each of the eighteen data lines DL1 to DL18 shown in FIG. 5 may be defined as the first to fifth pixels PX1 to PX5 described with reference to FIG. 6.

Figure 7:
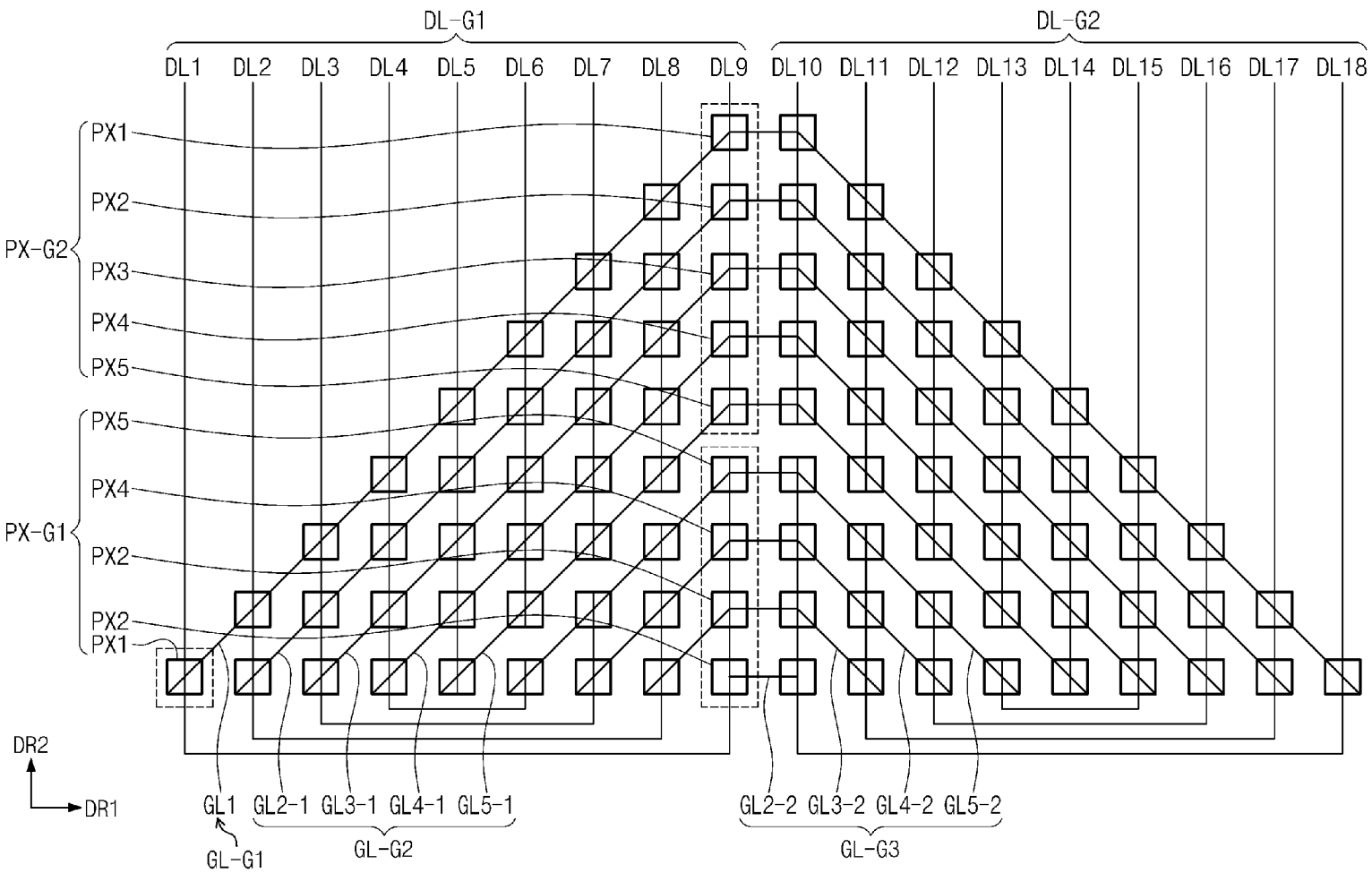
FIG. 7 is a view illustrating gate lines of a display panel according to an embodiment of the inventive concept.

FIG. 7 is a view illustrating gate lines of a display panel according to an embodiment of the inventive concept. FIGS. 8A to 8E are views illustrating a scanning method of a gate signal according to an embodiment of the inventive concept. Referring to FIGS. 7 to 8E, first to fifth pixels PX1 to PX5 connected to the first data line DL1 and the ninth data line DL9 represent first to fifth pixels connected to different data lines.

As shown in FIG. 7, gate lines GL1, GL2-1 to GL5-1, and GL2-2 to GL5-2 are connected to different numbers of pixels. The gate lines GL1, GL2-1 to GL5-1, and GL2-2 to GL5-2 may be classified into a first gate line group GL-G1, a second gate line group GL-G2, and a third gate line group GL-G3.

Figure 8A:
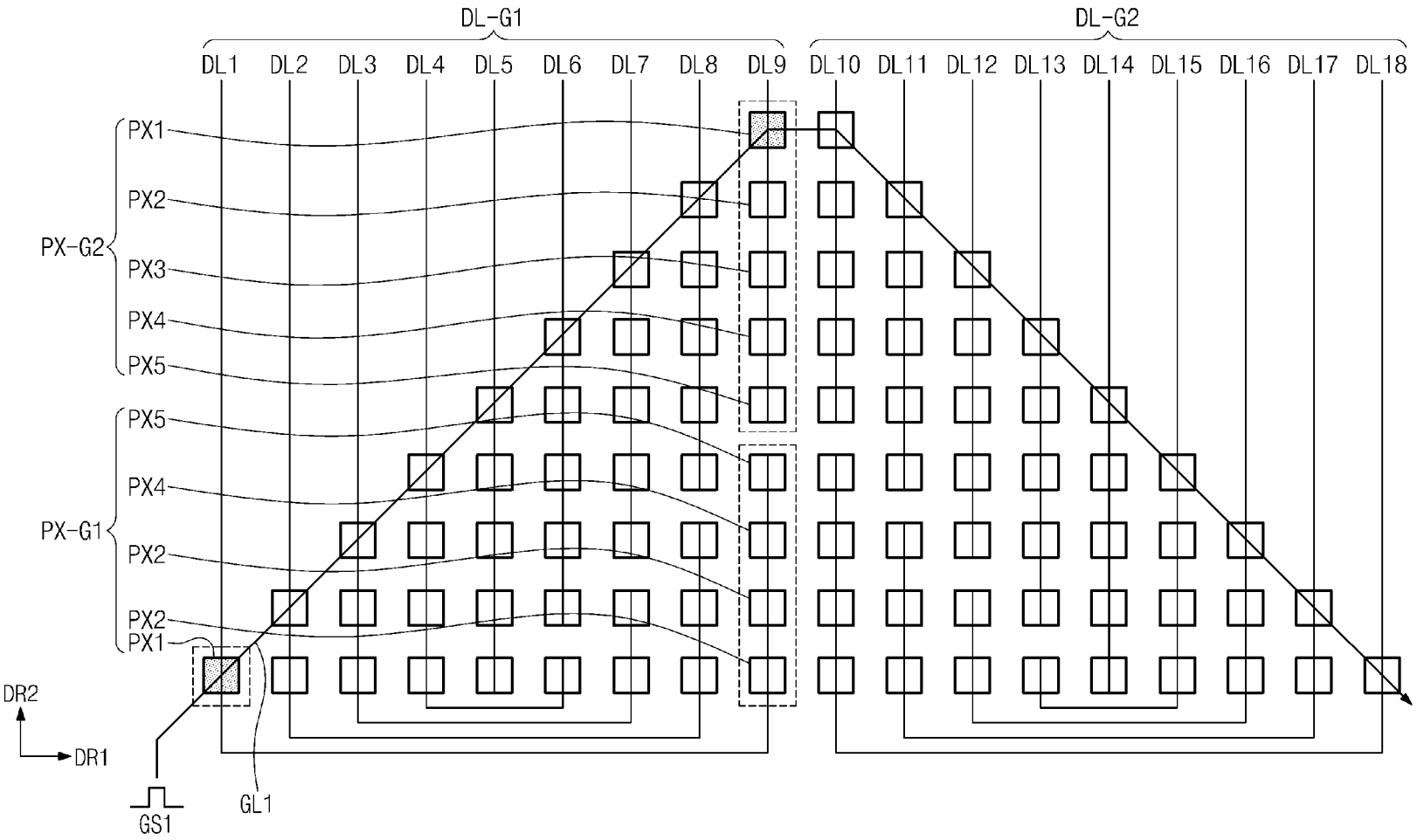
FIGS. 8A to 8E are views illustrating a scanning method of a gate signal according to an embodiment of the inventive concept.

As shown in FIGS. 7 and 8A, the first gate line group GL-G1 includes a first gate line GL1. First pixels PX1 connected to the data lines DL1 to DL18 are connected to the first gate line GL1. The first pixels PX1 are turned on in response to a gate signal GS1 applied to the first gate line GL1.

As shown in FIG. 7, the second gate line group GL-G2 includes second to fifth gate lines GL2-1 to GL5-1. The third gate line group GL-G3 includes sixth to ninth gate lines GL2-2 to GL5-2.

Figure 8B:
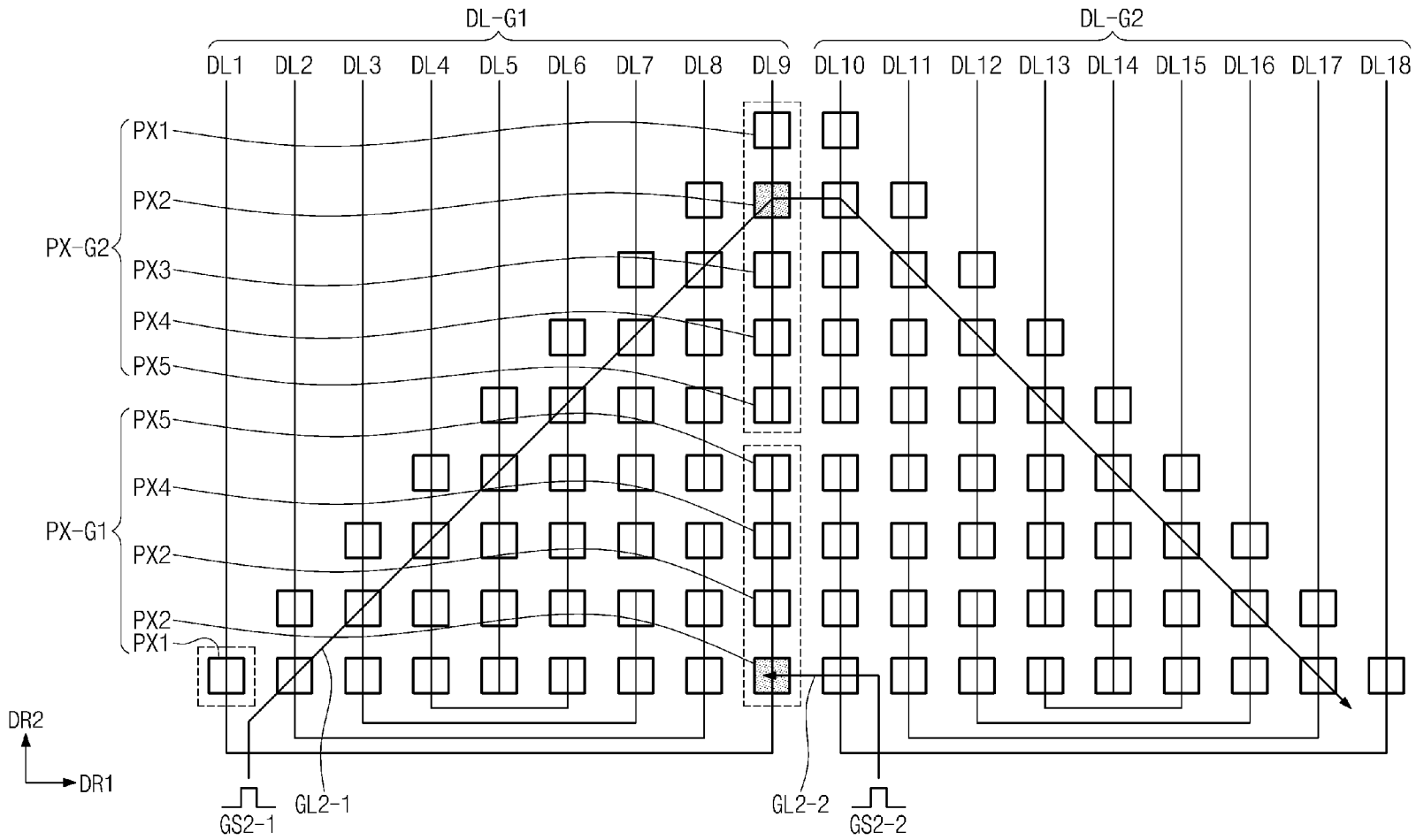

As shown in FIGS. 7 and 8B, second pixels PX2 connected to the data lines DL1 to DL18 are connected to the second and sixth gate lines GL2-1 and GL2-2. The second pixels PX2 are turned on in response to gate signals GS2-1 and GS2-2 applied to the second and sixth gate lines GL2-1 and GL2-2. In more detail, the second pixels PX2 connected to the first data line DL1 and the eighteenth data line DL18 are turned on in response to the gate signal GS2-2 applied to the sixth gate line GL2-2, and the remaining second pixels PX2 are turned on in response to the gate signal GS2-1 applied to the second gate line GL2-1.

Figure 8C:
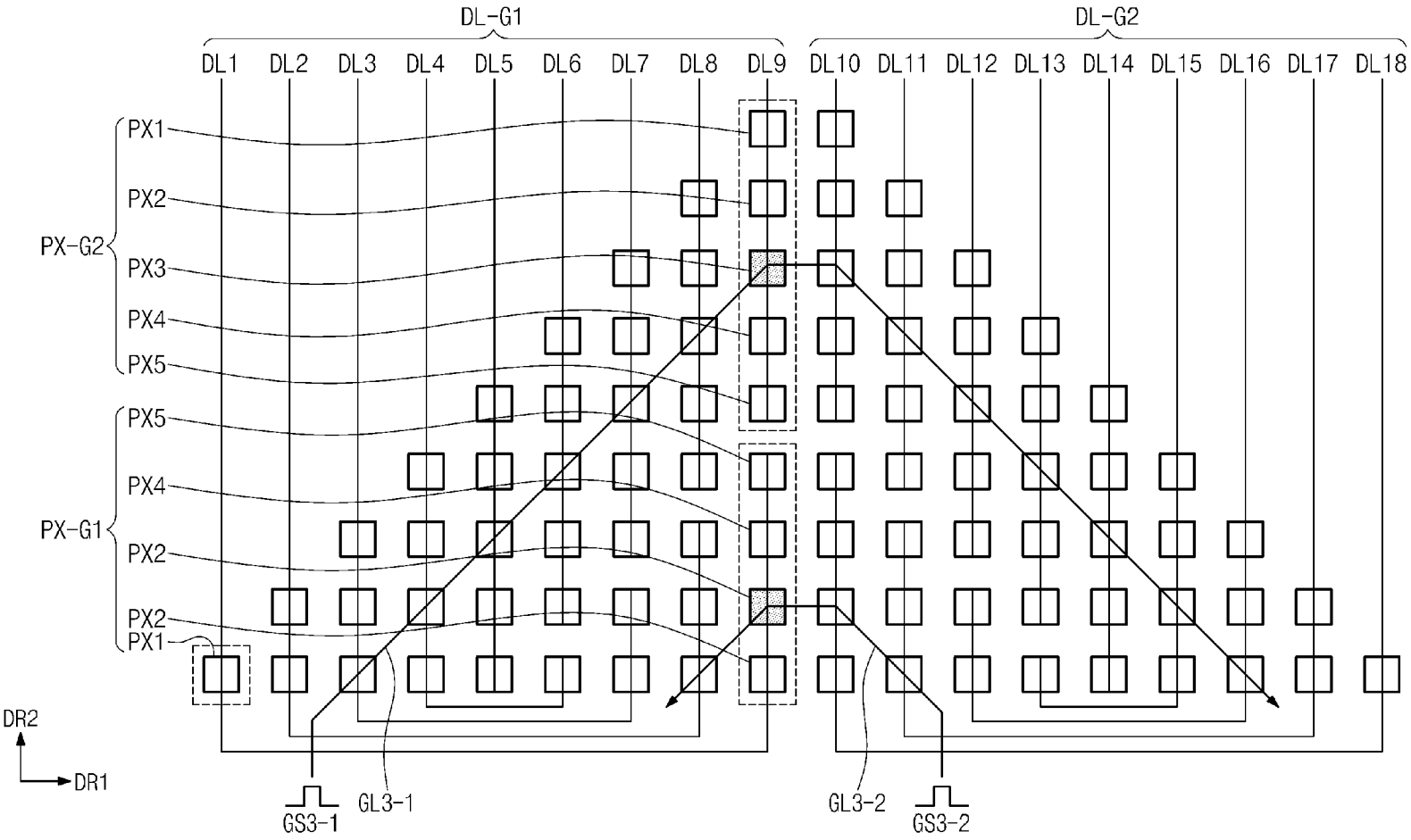
Figure 8D:
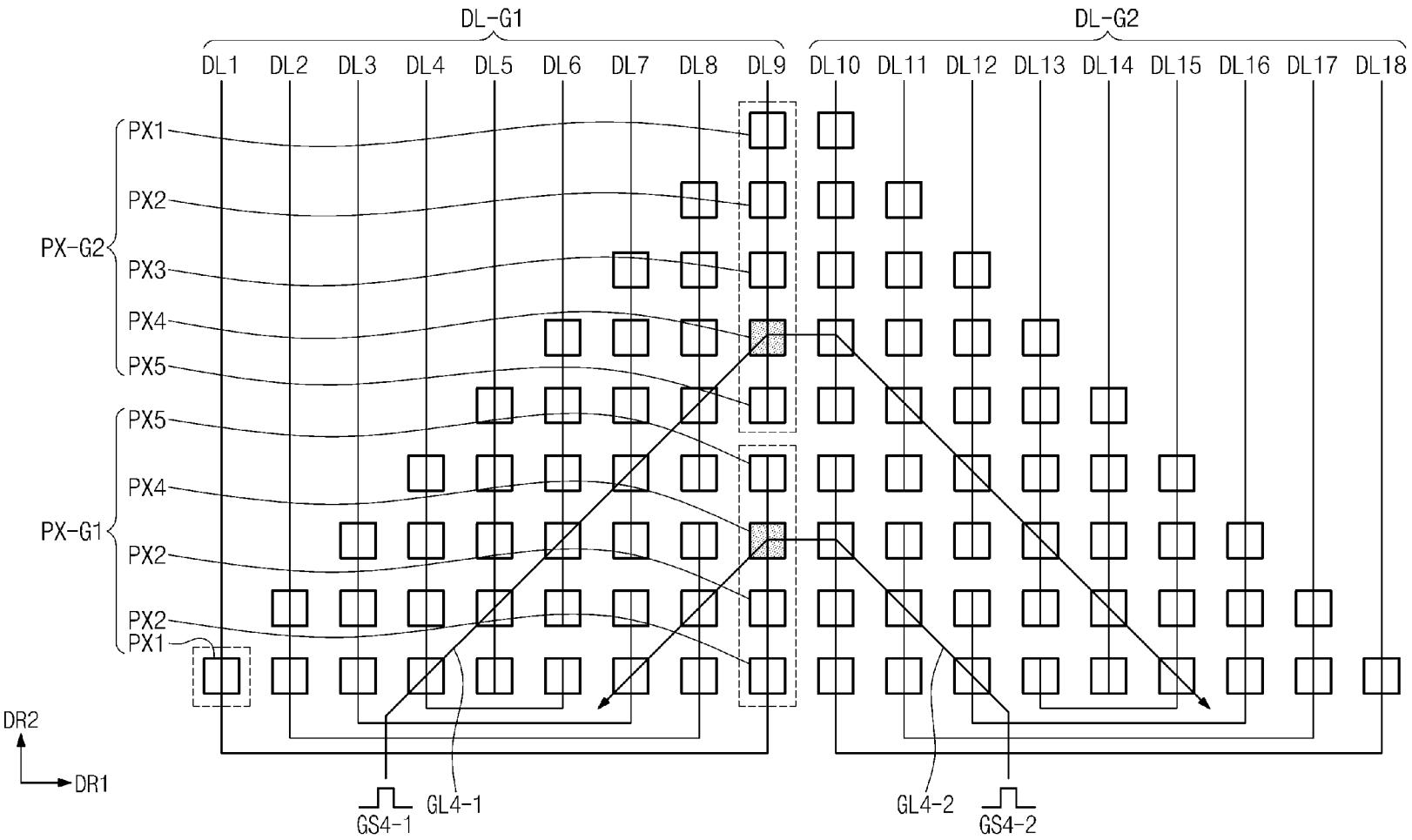
Figure 8E:
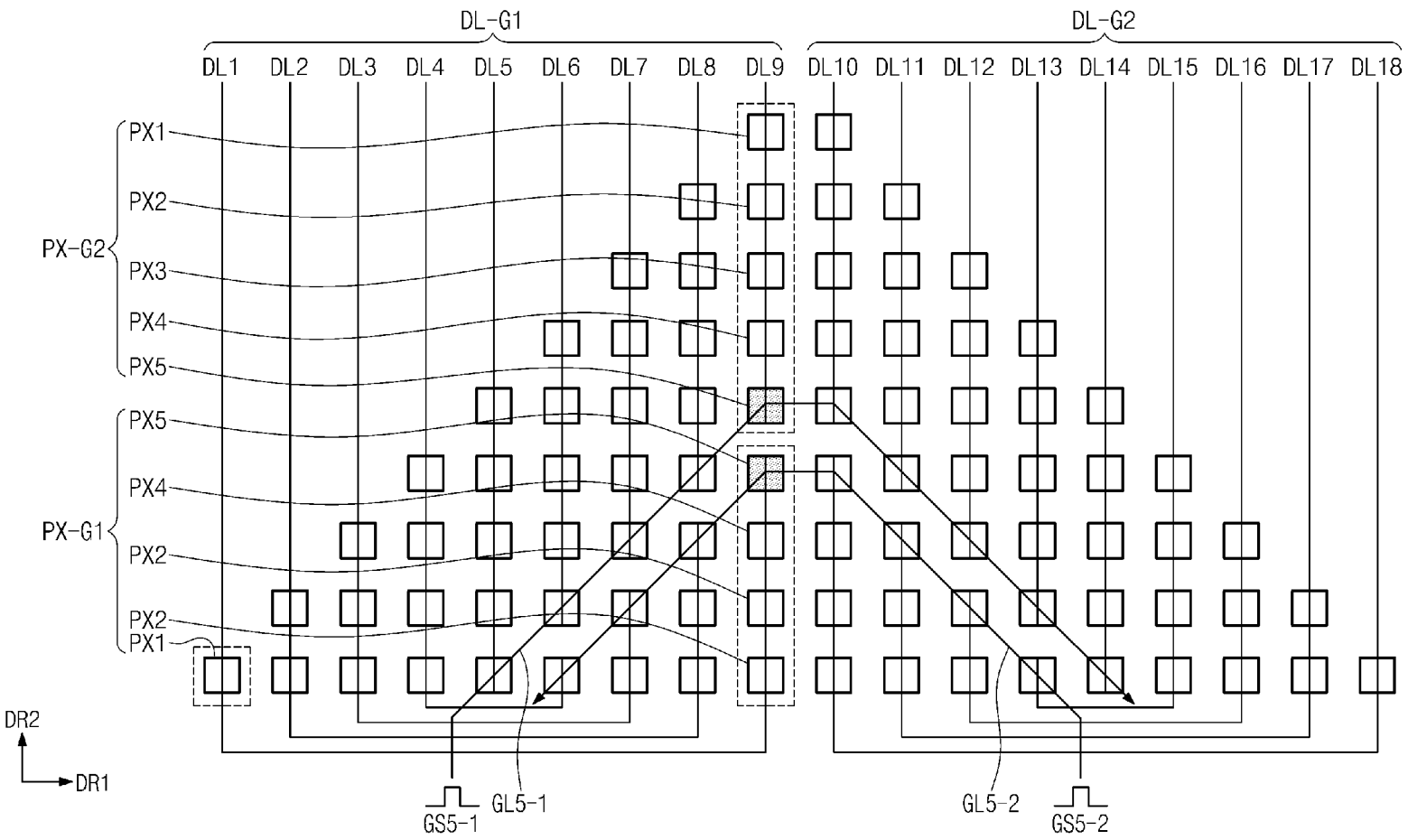

As shown in FIGS. 8C to 8E, the third pixels PX3 are turned on in response to gate signals GS3-1 and GS3-2 applied to the third and seventh gate lines GL3-1 and GL3-2. The fourth pixels PX4 are turned on in response to gate signals GS4-1 and GS4-2 applied to the fourth and eighth gate lines GL4-1 and GL4-2. The fifth pixels PX5 are turned on in response to gate signals GS5-1 and GS5-2 applied to the fifth and ninth gate lines GL5-1 and GL5-2.

Figure 9:
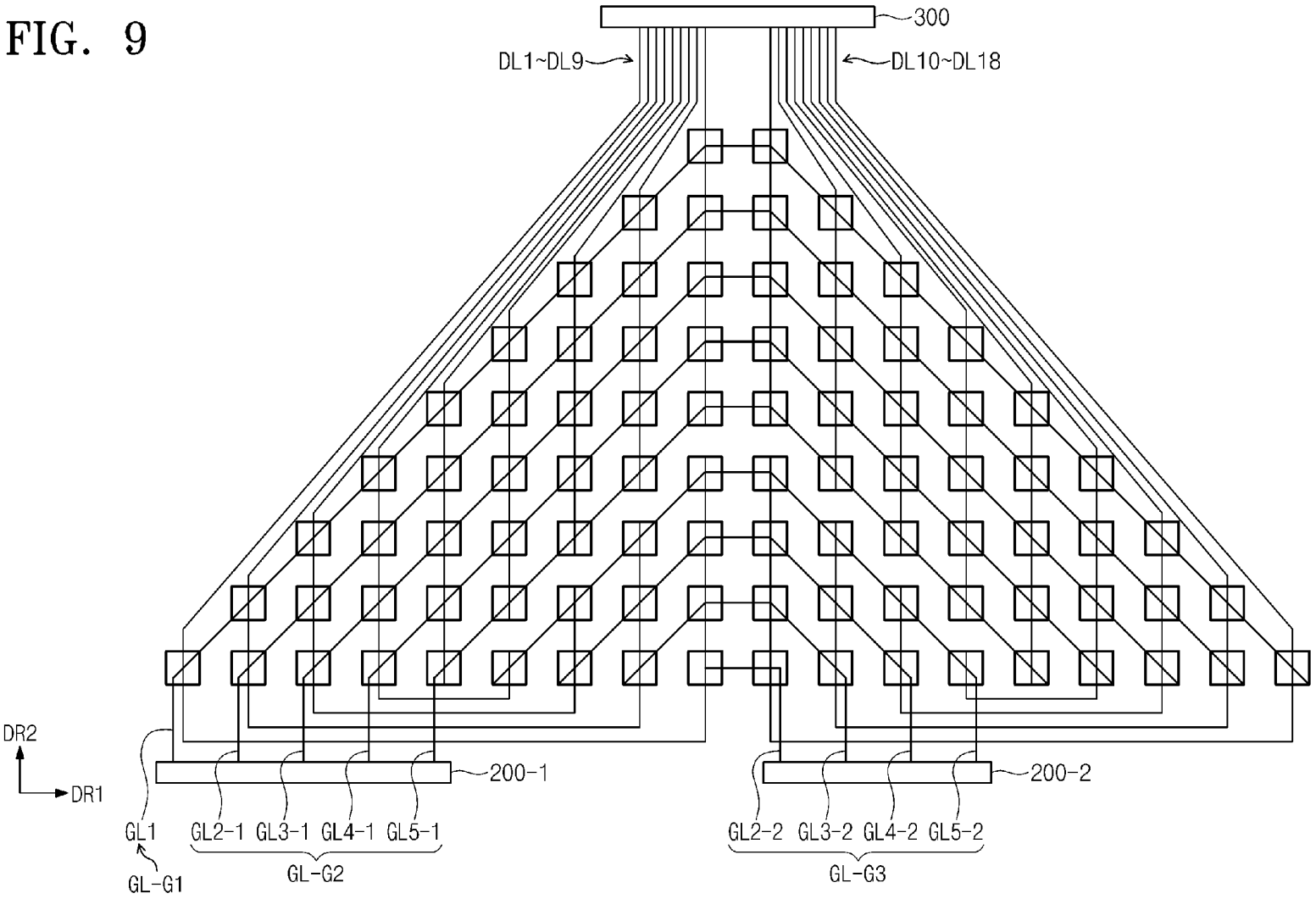
FIG. 9 is a plan view illustrating a display device according to an embodiment of the inventive concept.
Figure 10:
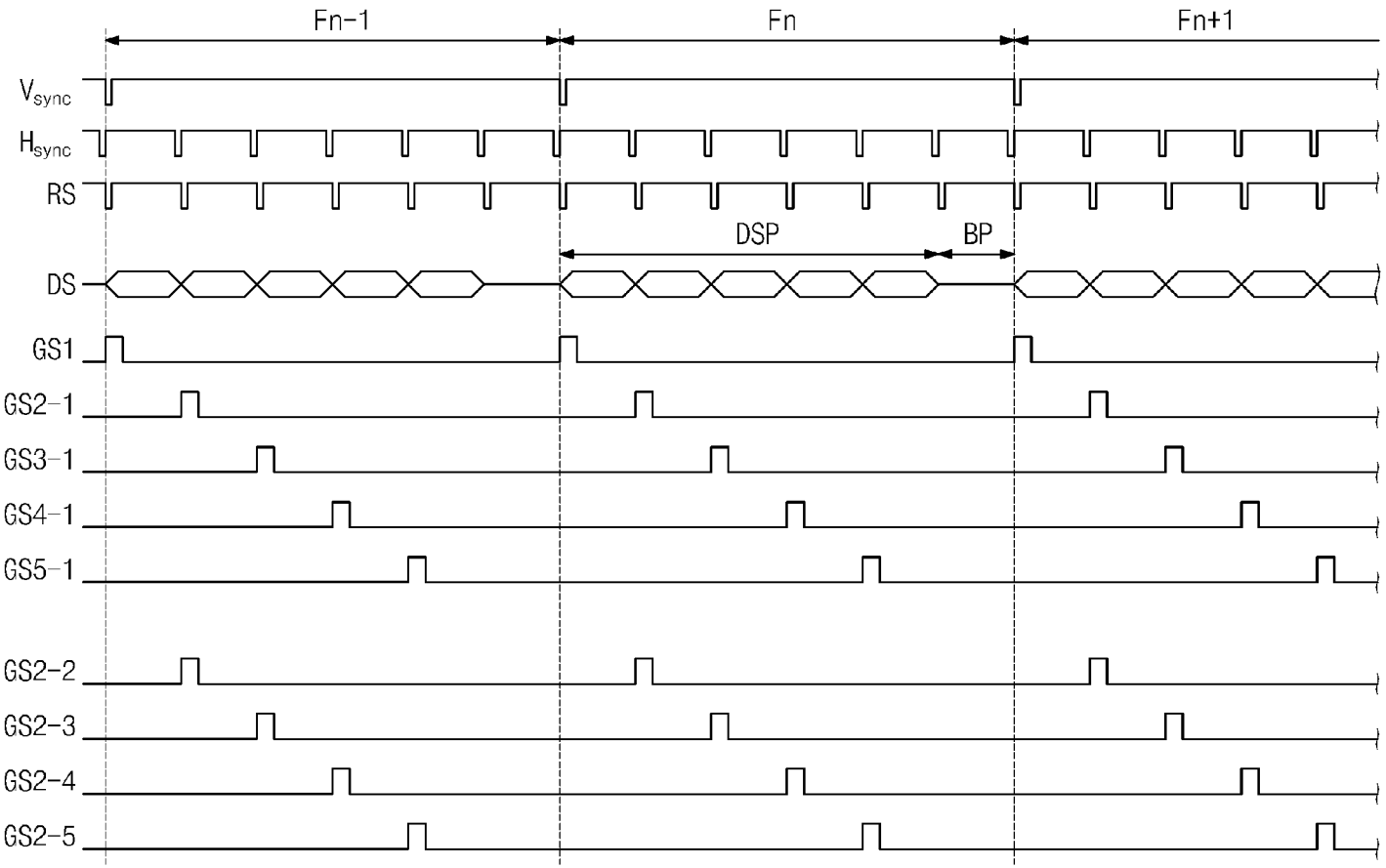
FIG. 10 is a timing diagram illustrating signals depending on a driving method of a display device according to an embodiment of the inventive concept.

FIG. 9 is a plan view illustrating a display device according to an embodiment of the inventive concept. FIG. 10 is a timing diagram illustrating signals depending on a driving method of a display device according to an embodiment of the inventive concept. The connection relationship between a gate line and a data line for the pixels, described with reference to FIGS. 5 and 7, may be the same or substantially the same as that applied to the display device according to the embodiments of FIGS. 9 and 10.

As shown in FIG. 9, the display device includes a first gate driver 200-1, a second gate driver 200-2, and a data driver 300. The first gate driver 200-1, the second gate driver 200-2, and the data driver 300 may be disposed in the non-display area NDR of FIG. 3A.

Each of the first gate driver 200-1 and the second gate driver 200-2 receives the first control signal CONT1 as shown in FIG. 1. The first gate driver 200-1 is connected to the first gate line group GL-G1 and the second gate line group GL-G2, and the second gate driver 200-2 is connected to the third gate line group GL-G3.

Referring to FIG. 10, a vertical sync signal Vsync defines a plurality of frame intervals Fn−1, Fn, and Fn+1. The display device displays an image during each of the plurality of frame intervals Fn−1, Fn, and Fn+1. The plurality of frame intervals Fn−1, Fn, and Fn+1 include a display interval DSP and a non-display interval BP. Moreover, the non-display interval BP may be omitted.

A horizontal sync signal Hsync defines a plurality of horizontal intervals where the data signals DS are outputted from the data driver 300. The data driver 300 outputs data signals DS to the data lines DL1 to DL18 at each of the horizontal intervals of the display interval DSP in response to a load signal RS.

The first gate driver 200-1 outputs first to fifth gate signals GS1 and GS2-1 to GS5-1 sequentially to the first to fifth gate lines GL1 and GL2-1 to GL5-1 during the display interval DSP. Each of the first to fifth gate signals GS1 and GS2-1 to GS5-1 is applied to a corresponding gate line among the first to fifth gate lines GL1 and GL2-1 to GL5-1 at a corresponding horizontal interval among the horizontal intervals of the display interval DSP.

The second gate driver 200-2 outputs sixth to ninth gate signals GS2-2 to GS5-2 sequentially to the sixth to ninth gate lines GL2-2 to GL5-2 during the display interval DSP. The second gate driver 200-2 may output delayed signals as compared to the first gate driver 200-1.

As described with reference to FIG. 8B, in order to turn on the second pixels PX2 concurrently (e.g., simultaneously), the second gate signal GS2-1 and the sixth gate signal GS2-2 has the same or substantially the same activation interval (e.g., a high interval in FIG. 10). As shown in FIGS. 8C to 8E, in order for the display panel DP to operate, the third gate signal GS3-1 and the seventh gate signal GS3-2 have the same or substantially the same activation interval; the fourth gate signal GS4-1 and the eighth gate signal GS4-2 have the same or substantially the same activation interval; and the fifth gate signal GS5-1 and the ninth gate signal GS5-2 have the same or substantially the same activation interval.

The display device shown in FIGS. 9 and 10 may display an image during the frame interval with five times of gate signal scanning with respect to nine pixel rows. As the number of scanning is reduced, the display device may display a large number of images in the same time. That is, the driving efficiency of a display device having an atypical pixel array is improved.

Figure 11:
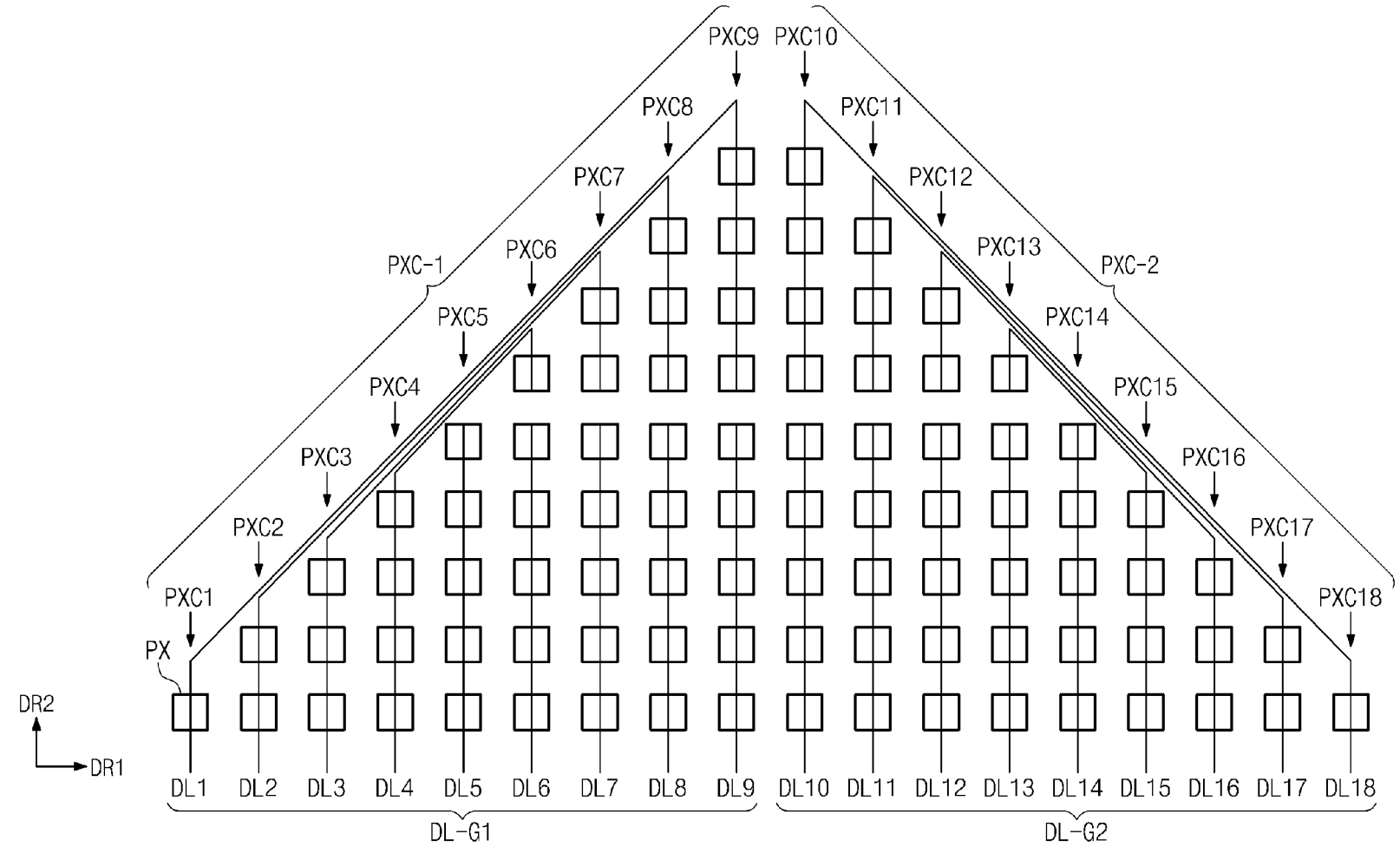
FIG. 11 is a view illustrating gate lines of a display panel according to another embodiment of the inventive concept.
Figure 12:
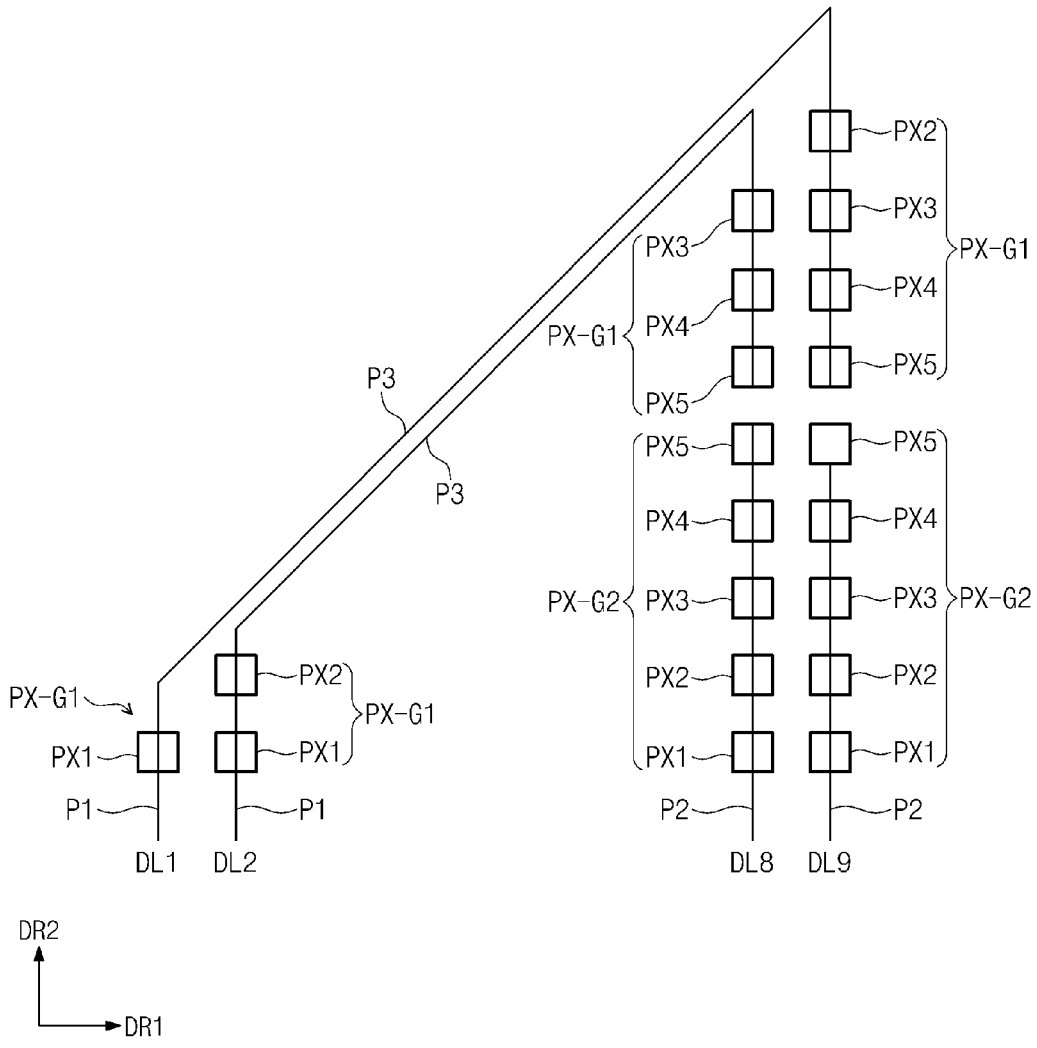
FIG. 12 is an enlarged view of a portion of FIG. 11.
Figure 13:
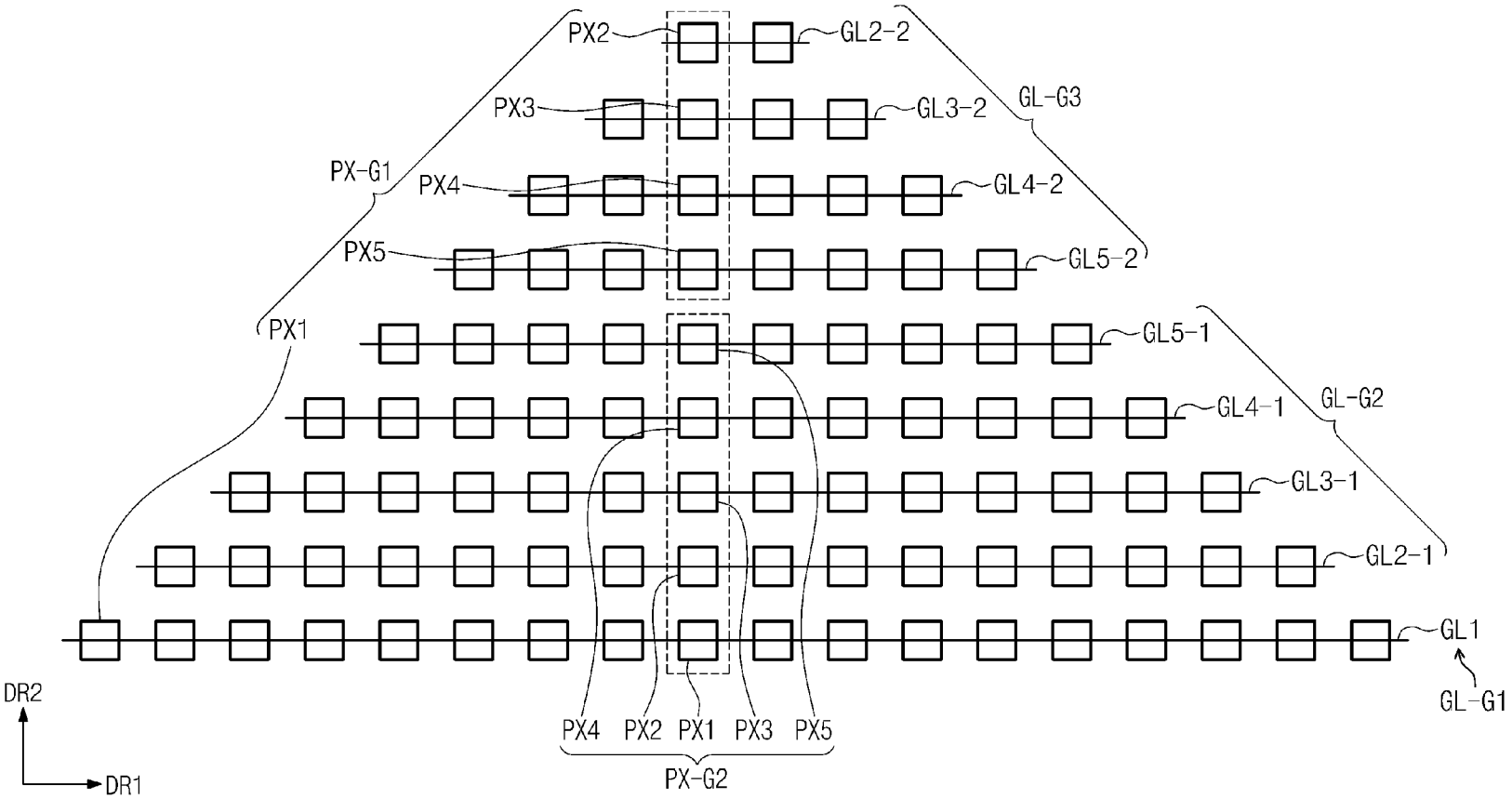
FIG. 13 is a view illustrating gate lines of a display panel according to another embodiment of the inventive concept.

FIG. 11 is a view illustrating gate lines of a display panel according to another embodiment of the inventive concept. FIG. 12 is an enlarged view of a portion of FIG. 11. FIG. 13 is a view illustrating gate lines of a display panel according to another embodiment of the inventive concept. Hereinafter, a display device according to another embodiment of the inventive concept will be described with reference to FIGS. 11 to 13. Overlapping descriptions for the configuration described with reference to FIGS. 1 to 10 are omitted.

As shown in FIGS. 11 and 12, the pixel of the first pixel column PXC1 and the pixels connected to the first data line DL1 among the pixels of the ninth data line DL9 are defined as a first pixel group PX-G1. The pixels connected to the ninth data line DL9 among the pixels of the ninth pixel column PXC9 are defined as a second pixel group PX-G2.

The second pixel group PX-G2 may include five pixels PX1 to PX5 continuously arranged from the bottom in the second direction DR among the pixels of the ninth pixel column PXC9. The first pixel group PX-G1 may include the pixel PX1 of the first pixel column PXC1 and four pixels PX2 to PX5 continuously arranged from the top in the second direction DR among the pixels of the ninth pixel column PXC9.

The five pixels PX1 to PX5 of each of the first pixel group PX-G1 and the second pixel group PX-G2 are defined as first to fifth pixels PX1 to PX5 according to the order in which the five pixels PX1 to PX5 are turned on. As a result, the pixels PX connected to each of the eighteen data lines DL1 to DL18 shown in FIG. 11 may be defined as first to fifth pixels PX1 to PX5.

As shown in FIG. 13, gate lines GL1, GL2-1 to GL5-1, and GL2-2 to GL5-2 are connected to different numbers of pixels. The gate lines GL1, GL2-1 to GL5-1, and GL2-2 to GL5-2 may be classified into a first gate line group GL-G1, a second gate line group GL-G2, and a third gate line group GL-G3.

The first gate line group GL-G1 includes a first gate line GL1. First pixels PX1 connected to the data lines DL1 to DL18 are connected to the first gate line GL1.

The second gate line group GL-G2 includes second to fifth gate lines GL2-1 to GL5-1. The third gate line group GL-G3 includes sixth to ninth gate lines GL2-2 to GL5-2.

Second pixels PX2 connected to the data lines DL1 to DL18 are connected to the second and sixth gate lines GL2-1 and GL2-2. Third pixels PX3 connected to the data lines DL1 to DL18 are connected to the third and seventh gate lines GL3-1 and GL3-2. Fourth pixels PX4 connected to the data lines DL1 to DL18 are connected to the fourth and eighth gate lines GL4-1 and GL4-2. Fifth pixels PX5 connected to the data lines DL1 to DL18 are connected to the fifth and ninth gate lines GL5-1 and GL5-2.

The first pixels PX1 are turned on in response to the gate signal GS1 as shown in FIG. 10 applied to the first gate line GL1. The second pixels PX2 are turned on in response to the gate signals GS2-1 and GS2-2 as shown in FIG. 10 applied to the second and sixth gate lines GL2-1 and GL2-2. Since a driving method of a display device shown in FIGS. 11 to 13 is the same or substantially the same as that described with reference to FIGS. 7 to 10, detailed description thereof is omitted.

Figure 14:
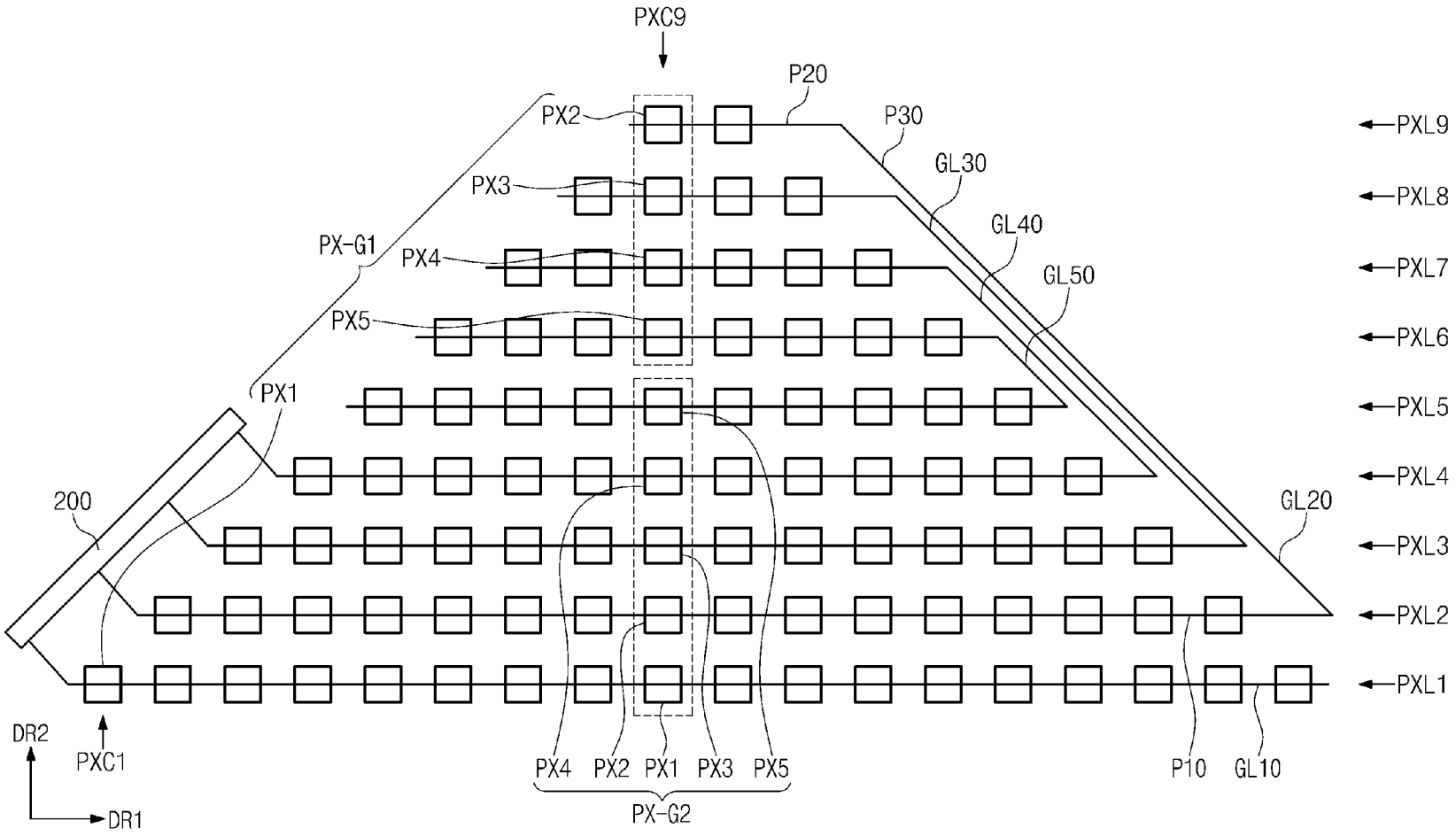
FIG. 14 is a view illustrating gate lines of a display panel according to another embodiment of the inventive concept.
Figure 15:
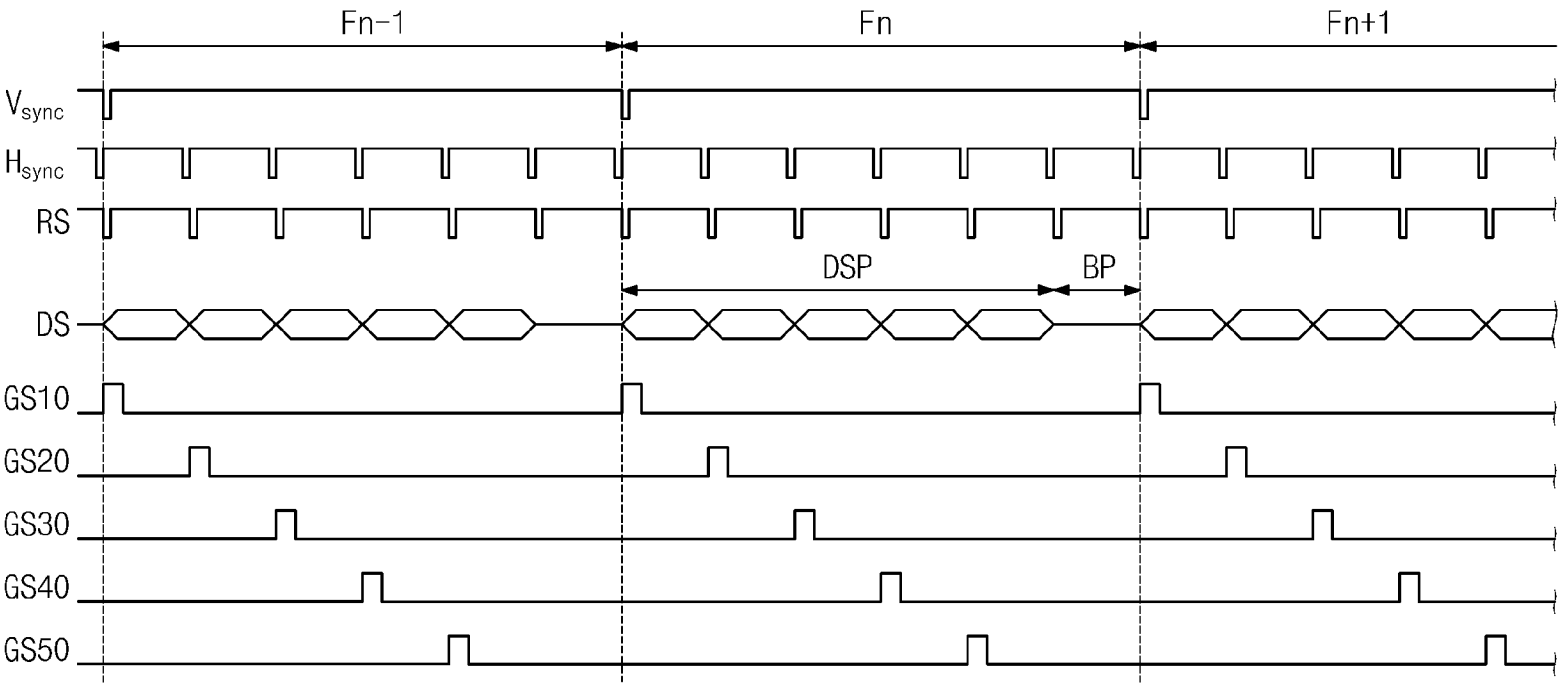
FIG. 15 is a timing diagram illustrating signals depending on a driving method of a display device according to another embodiment of the inventive concept.

FIG. 14 is a view illustrating gate lines of a display panel according to another embodiment of the inventive concept. FIG. 15 is a timing diagram illustrating signals depending on a driving method of a display device according to another embodiment of the inventive concept. Hereinafter, a display device according to another embodiment of the inventive concept will be described with reference to FIGS. 14 and 15. Overlapping descriptions for the configuration described with reference to FIGS. 1 to 13 are omitted.

The data lines DL1 to DL18 as shown in FIG. 11 are not shown in FIG. 14. A connection relationship of the data lines DL1 to DL18 for the pixels PX of FIG. 14 may be the same or substantially the same as that shown in FIGS. 11 and 12. Referring to FIG. 14, first to fifth pixels PX1 to PX5 connected to the first data line DL1 of FIG. 11 and the ninth data line DL9 of FIG. 11 represent first to fifth pixels connected to different data lines.

As shown in FIG. 14, the display device includes gate lines GL10 to GL50. The number of gate lines GL10 to GL50 is less than the number of pixel rows PXL1 to PXL9. In the example embodiment shown in FIG. 14, the display device includes nine pixel rows PXL1 to PXL9 and five gate lines GL10 to GL50.

The gate lines GL10 to GL50 are connected to the same number of pixels. The gate lines GL10 to GL50 are connected to eighteen pixels, respectively. The first gate line GL10, the second gate line GL20, the third gate line GL30, the fourth gate line GL40, and the fifth gate line GL50 are connected to the first pixels PX1, the second pixels PX2, the third pixels PX3, the fourth pixels PX4, and the fifth pixels PX5, respectively.

Each of the second to fifth gate lines GL20 to GL50 may include three portions P10, P20, and P30. Referring to the second gate line GL20, the three portions P10, P20, and P30 include a first portion P10 adjacent to the second pixel row PXL2, a second portion P20 adjacent to the ninth pixel row PXL9, and a third portion P30 connecting one end of the first portion P10 and one end of the second portion P20. The third portion P30 may be disposed in the non-display area NDR of FIG. 3A.

Each of the second to fifth gate lines GL20 to GL50 may be connected to two pixels included in one pixel column. For example, two second pixels PX2 included in the ninth pixel column PXC9 are connected to the second gate line GS20.

As shown in FIG. 15, the gate driver 200 outputs first to fifth gate signals GS10 to GS50 sequentially to the first to fifth gate lines GL10 to GL50 during the display interval DSP. Each of the first to fifth gate signals GS10 to GS50 are applied to a gate line corresponding to a corresponding horizontal interval of the display interval DSP. Pixels turned on by the gate signal receive data signals DS outputted in response to a load signal RS. For example, two second pixels PX2 included in the ninth pixel column PXC9 are turned on concurrently (e.g., simultaneously) in response to a second gate signal GS20, and receive data signals DS applied to the first data line DL1 and the ninth data line DL9, respectively.

The display device shown in FIGS. 14 and 15 may display an image during the frame interval with the less number of gate signal scanning with respect to the pixel rows PXL1 to PXL9. Furthermore, an image may be displayed by using (or utilizing) one gate driver.

As described above, a first pixel and a second pixel in one pixel column may be turned on concurrently (e.g., simultaneously). The first pixel and the second pixel are connected to two data lines, respectively. The concurrently (e.g., simultaneously) turned-on first pixel and second pixel respectively receive data signals applied to the two data lines during one horizontal interval.

Since some pixels are turned on concurrently (e.g., simultaneously), the number of scanning a gate signal for turning on all pixels included in the one pixel column is reduced. One frame interval has horizontal intervals corresponding to the number of scanning the gate signal. As the number of scanning the gate signal is reduced, each time of the horizontal intervals with respect to a frame interval (e.g., a predetermined frame interval) is increased.

The display device may display an image during the frame interval by the number of scanning a gate signal, which is less than the number of pixel rows. Accordingly, the driving efficiency of a display device with an atypical pixel array may be improved.

A first pixel and a second pixel in one pixel column may be connected to the same gate line. The first pixels and the second pixel are concurrently (e.g., simultaneously) turned on in response to a gate signal applied to the gate line. The display device may include gate lines whose number is less than the number of pixel rows.

The above-disclosed embodiments are to be considered illustrative and not restrictive, and the appended claims and their equivalents are intended to cover all such modifications, enhancements, and other embodiments, which fall within the spirit and scope of the inventive concept. Thus, to the maximum extent allowed by law, the spirit and scope of the inventive concept is to be determined by the broadest permissible interpretation of the following claims and their equivalents, and shall not be restricted or limited by the foregoing detailed description.

What is claimed is:

1. A display device comprising a display panel having a display area, the display device comprising:

a first plurality of pixels arranged in a first pixel column from among a plurality of pixel columns in the display area;

a second plurality of pixels arranged in a second pixel column from among the plurality of pixel columns, the second plurality of pixels being greater in number than the first plurality of pixels;

a first data line connected to the first plurality of pixels and to a first group of pixels of the second plurality of pixels, the first group of pixels comprising less than all of the second plurality of pixels;

a second data line connected to a second group of pixels of the second plurality of pixels; and gate lines connected to a pixel in each of the first pixel column and the second pixel column.

2. The display device of claim 1, wherein the first group of pixels continuously extend along an extension direction of the second pixel column, and the second group of pixels continuously extend from the first group of pixels.

3. The display device of claim 1, wherein the first plurality of pixels and the first group of pixels of the second plurality of pixels connected to the first data line are defined as a first connected pixel group, wherein the second group of pixels of the second plurality of pixels connected to the second data line are defined as a second connected pixel group, and wherein the first connected pixel group and the second connected pixel group include same number of pixels.

4. The display device of claim 3, further comprising a third plurality of pixels arranged in a third pixel column between the first pixel column and the second pixel column, the third plurality of pixels comprising a different number of pixels than that of the first plurality of pixels in the first pixel column and a different number of pixels than that of the second plurality of pixels in the second pixel column.

5. The display device of claim 4, wherein the third plurality of pixels comprises the same number of pixels as the first connected pixel group.

6. The display device of claim 4, wherein the first data line comprises a first portion adjacent to the first pixel column, a second portion adjacent to the second pixel column, and a third portion connecting one end of the first portion to one end of the second portion.

7. The display device of claim 3, wherein the pixels of the second connected pixel group are configured to be sequentially turned on, and each of the pixels of the first connected pixel group is configured to be turned on in synchronization with a corresponding pixel from among the pixels of the second connected pixel group.

8. The display device of claim 7, wherein the gate lines comprise:

first gate lines configured to receive gate signals for turning on pixels of the first plurality of pixels arranged in the first pixel column and pixels of the second group of pixels of the second plurality of pixels; and second gate lines configured to receive gate signals for turning on the first group of pixels of the second plurality of pixels in the second pixel column.

9. The display device of claim 8, wherein one first gate line from among the first gate lines is connected to a pixel of the first plurality of pixels in the first pixel column and to a pixel of the second group of pixels of the second plurality of pixels in the second pixel column.

10. The display device of claim 9, wherein another first gate line from among the first gate lines is not connected to the pixels of the first connected pixel group, and is connected to another pixel of the second connected pixel group.

11. The display device of claim 7, wherein each of the pixels of the first connected pixel group is connected to a same gate line as that of which a corresponding pixel among the pixels of the second connected pixel group is connected.

12. The display device of claim 3, wherein each of the pixels of the first connected pixel group and the second connected pixel group comprises:

a thin film transistor connected to a corresponding data line from among the first data line and the second data line, and connected to a corresponding gate line from among the gate lines; and a liquid crystal capacitor connected to the thin film transistor.

13. The display device of claim 3, wherein each of the pixels of the first connected pixel group and the second connected pixel group comprises:

a first thin film transistor connected to a corresponding data line from among the first data line and the second data line, and connected to a corresponding gate line from among the gate lines;

a capacitor connected to the first thin film transistor;

a second thin film transistor connected to the first thin film transistor and to the capacitor; and an organic light emitting diode connected to the second thin film transistor.

14. The display device of claim 1, wherein a group of continuously disposed pixel columns from among the plurality of pixel columns are defined as a first pixel column group, and each of the pixel columns of the first pixel column group comprises different numbers of pixels than other ones of the pixel columns of the first pixel column group.

15. The display device of claim 14, wherein a number of pixels of each of the pixel columns of the first pixel column group gradually decreases as it is farther away from a pixel column having a largest number of pixels from among the first pixel column group.

16. The display device of claim 15, wherein another group of continuously disposed pixel columns from among the plurality of pixel columns are defined as a second pixel column group, and each of the pixel columns of the second pixel column group comprises different numbers of pixels than other ones of the pixel columns of the second pixel column group, wherein a number of pixels of each of the pixel columns of the second pixel column group gradually decreases as it is farther away from a pixel column having a largest number of pixels from among the second pixel column group.

17. The display device of claim 16, wherein the pixel column of the first pixel column group having the largest number of pixels, and the pixel column of the second pixel column group having the largest number of pixels are at a center of the plurality of pixel columns; and wherein the display area has a triangular form on a front of the display panel.

18. The display device of claim 17, wherein the display panel further comprises a non-display area adjacent to the display area, and wherein a border of the non-display area has a triangular form.

19. The display device of claim 17, wherein the display panel has a triangular form on the front.

20. The display device of claim 1, wherein the first group of pixels of the second plurality of pixels comprises a bottommost pixel in the second pixel column, wherein the second group of pixels of the second plurality of pixels comprises an uppermost pixel in the second pixel column, and wherein the first and second groups of the second plurality of pixels together comprise all of the pixels in the second pixel column.

* * * * *